US009383679B2

(12) United States Patent
Eto

(10) Patent No.: US 9,383,679 B2
(45) Date of Patent: Jul. 5, 2016

(54) DEVELOPER CONTAINER AND IMAGE FORMING APPARATUS INCLUDING THE SAME

(71) Applicant: KYOCERA Document Solutions Inc., Osaka-shi, Osaka (JP)

(72) Inventor: Daisuke Eto, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 14/778,712

(22) PCT Filed: Dec. 24, 2014

(86) PCT No.: PCT/JP2014/084137
§ 371 (c)(1),
(2) Date: Sep. 21, 2015

(87) PCT Pub. No.: WO2015/098958
PCT Pub. Date: Jul. 2, 2015

(65) Prior Publication Data

US 2016/0054678 A1 Feb. 25, 2016

(30) Foreign Application Priority Data

Dec. 27, 2013 (JP) ..... 2013-270619

(51) Int. Cl.
*G03G 15/08* (2006.01)

(52) U.S. Cl.
CPC ..... *G03G 15/0865* (2013.01); *G03G 15/0886* (2013.01)

(58) Field of Classification Search
CPC ..... G03G 15/0872; G03G 15/0886; G03G 15/0865; G03G 15/0877; G03G 21/1676; G03G 15/0868; G03G 15/0863; G03G 2215/0692; G03G 15/0893; G03G 2221/1823; G03G 15/0875; G03G 21/12; G03G 15/0896
See application file for complete search history.

(56) References Cited

U.S. PATENT DOCUMENTS 8,923,734 B2 * 12/2014 Abler ..... G03G 15/0836 399/262
2007/0122205 A1 5/2007 Taguchi et al.
(Continued)

FOREIGN PATENT DOCUMENTS

EP 1 076 271 2/2001
JP 2000-187382 7/2000
(Continued)

OTHER PUBLICATIONS

International Search Report.

*Primary Examiner* — Roy Y Yi
(74) *Attorney, Agent, or Firm* — Gerald E. Hespos; Michael J. Porco; Matthew T. Hespos

(57) ABSTRACT

A developer container (30) includes a container body (31), a movable wall (34), and a backward movement preventing mechanism (55). The container body (31) includes an inner surface (31K) defining a cylindrical internal space (31H) extending in a longitudinal direction, and a developer discharge port (319). The movable wall (34) includes an outer surface (34K) disposed slidably in close contact with the inner surface (31K) of the container body (31), and a conveying surface (340S). The conveying surface (340S) defines a storage space (31S) for developer. The movable wall (34) moves in the longitudinal direction from an initial position at one end side to the developer discharge port (319) while conveying the developer in the storage space (31S) to the developer discharge port (319). The backward movement preventing mechanism (55) prevents the movable wall (34) at the developer discharge port (319) from moving back toward the initial position.

5 Claims, 18 Drawing Sheets

(56) References Cited

U.S. PATENT DOCUMENTS

| | | | |
|---|---|---|---|
| 2007/0147900 | A1 | 6/2007 | Taguchi et al. |
| 2007/0147902 | A1 | 6/2007 | Taguchi et al. |
| 2007/0154243 | A1 | 7/2007 | Taguchi et al. |
| 2007/0154244 | A1 | 7/2007 | Taguchi et al. |
| 2007/0160393 | A1 | 7/2007 | Taguchi et al. |
| 2007/0160394 | A1 | 7/2007 | Taguchi et al. |
| 2007/0177886 | A1 | 8/2007 | Taguchi et al. |
| 2007/0230974 | A1 | 10/2007 | Ohkawa et al. |
| 2009/0269112 | A1 | 10/2009 | Fukunaga et al. |
| 2011/0002713 | A1 | 1/2011 | Taguchi et al. |
| 2011/0008075 | A1 | 1/2011 | Taguchi et al. |
| 2011/0286771 | A1 | 11/2011 | Taguchi et al. |

FOREIGN PATENT DOCUMENTS

| | | |
|---|---|---|
| JP | 2001-92230 | 4/2001 |
| JP | 2003-280344 | 10/2003 |
| JP | 2007-148320 | 6/2007 |
| JP | 2007-264223 | 10/2007 |
| JP | 2009-265395 | 11/2009 |
| JP | 2013-64875 | 4/2013 |

* cited by examiner

BACKWARD
FORWARD
LEFT
RIGHT
TOP
BOTTOM
30
31
31T
37
38
39
40
50
M
311
312
313
314
315
316
317
318
319
391
392

DEVELOPER CONTAINER AND IMAGE FORMING APPARATUS INCLUDING THE SAME

TECHNICAL FIELD

The present invention relates to a developer container for containing developer and an image forming apparatus including the developer container.

BACKGROUND ART

Conventionally, toner containers such as one disclosed in Japanese Unexamined Patent Publication No. 2003-280344 are known as developer containers for containing developer. The toner container includes a toner discharge port and a rotary stirring member. Toner is discharged through the toner discharge port by rotation of the stirring member.

Japanese Unexamined Patent Publication No. 2009-265395 discloses a waste toner container for containing developer. The waste toner container includes a cylindrical container body having an outer circumferential portion formed with a helical groove. Collected toner is conveyed to one end of the container body along the helical groove by rotation of the container body.

In the toner container disclosed in Japanese Unexamined Patent Publication No. 2009-265395, toner is liable to remain in the region not affected by the rotational force of the conveying member, which makes it difficult to use up all the toner in the container. Further, even if the technique used for the waste container disclosed in Japanese Unexamined Patent Publication No. 2009-265395 is applied to the toner container, toner adhered to the groove will continue to rotate with the container body, so that the toner will remain in the container body. This has been a problem.

The present invention aims to provide a developer container capable of reducing the amount of developer remaining in a container body and reliably sealing a developer discharge port at the end of use of the developer container, and an image forming apparatus including the developer container.

SUMMARY

A developer container according to an aspect of the present invention comprises: a container body including an inner surface defining a cylindrical internal space extending in a longitudinal direction, and a storage space provided in the internal space for containing developer, the container body being formed with a developer discharge port in a lower part of the inner surface and communicating with the storage space for discharging developer therethrough; a movable wall disposed in the internal space of the container body, and including an outer surface disposed slidably in close contact with the inner surface, and a conveying surface defining the storage space in cooperation with the inner surface of the container body, the movable wall being movable in the longitudinal direction from an initial position set at one end side to the developer discharge port lying at the other end side of the internal space to seal the developer discharge port by the outer surface, while conveying the developer in the storage space to the developer discharge port; and a backward movement preventing mechanism configured to prevent the movable wall at the developer discharge port from moving back toward the initial position.

An image forming apparatus according to another aspect of the present invention comprises: the above-described developer container; an image carrier having a surface for allowing an electrostatic latent image to be formed thereon and operable to carry a developed image; a developing device configured to receive the developer supplied from the developer container and to supply the developer to the image carrier; and a transfer section configured to transfer the developed image from the image carrier onto a sheet.

The present invention provides a developer container capable of reducing the amount of developer remaining in a container body and reliably sealing a developer discharge port at the end of use of the developer container, and an image forming apparatus including the developer container.

DESCRIPTION OF EMBODIMENTS

Figure 1:
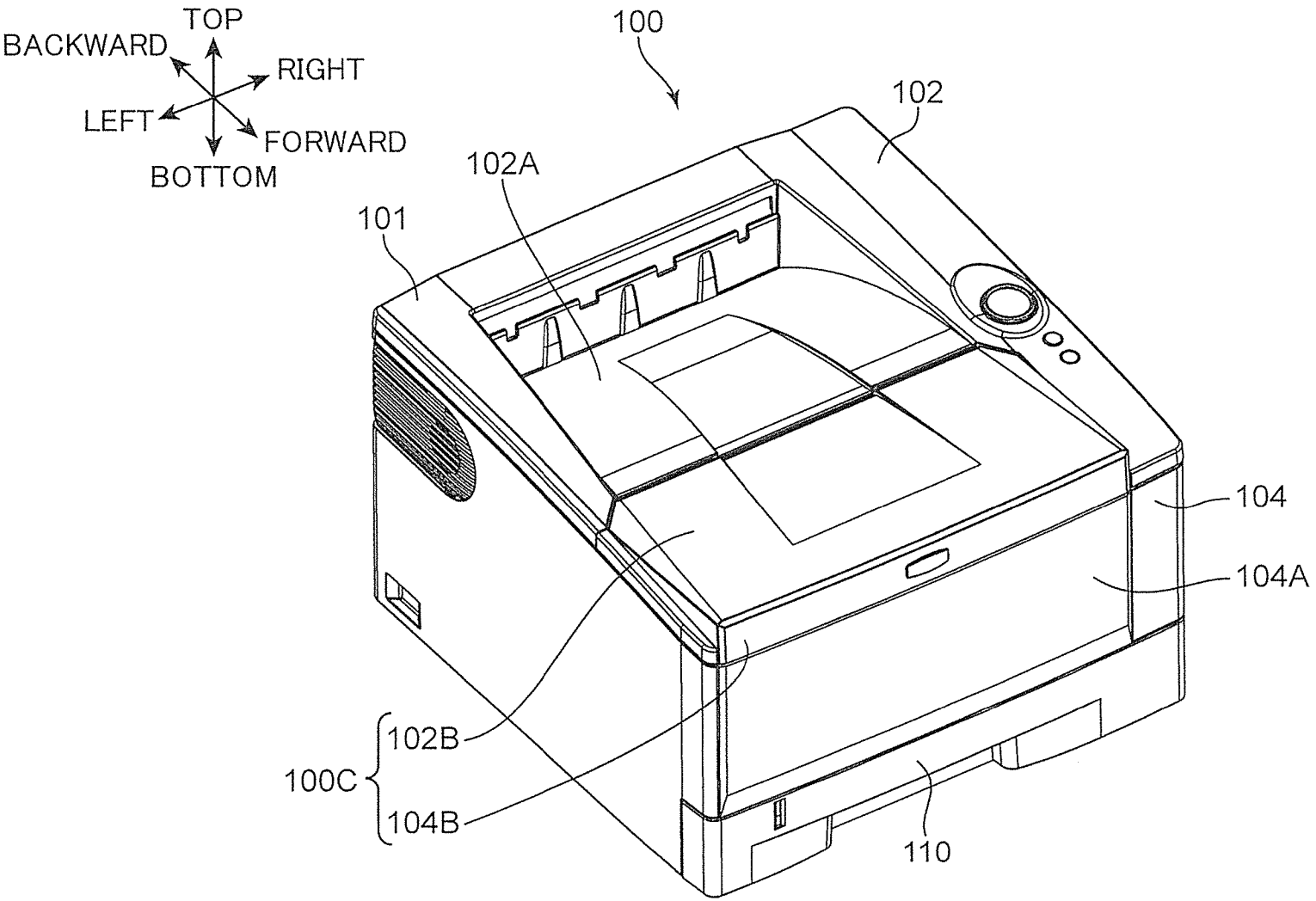
FIG. 1 is a perspective view of an image forming apparatus according to an embodiment of the present invention.
Figure 2:
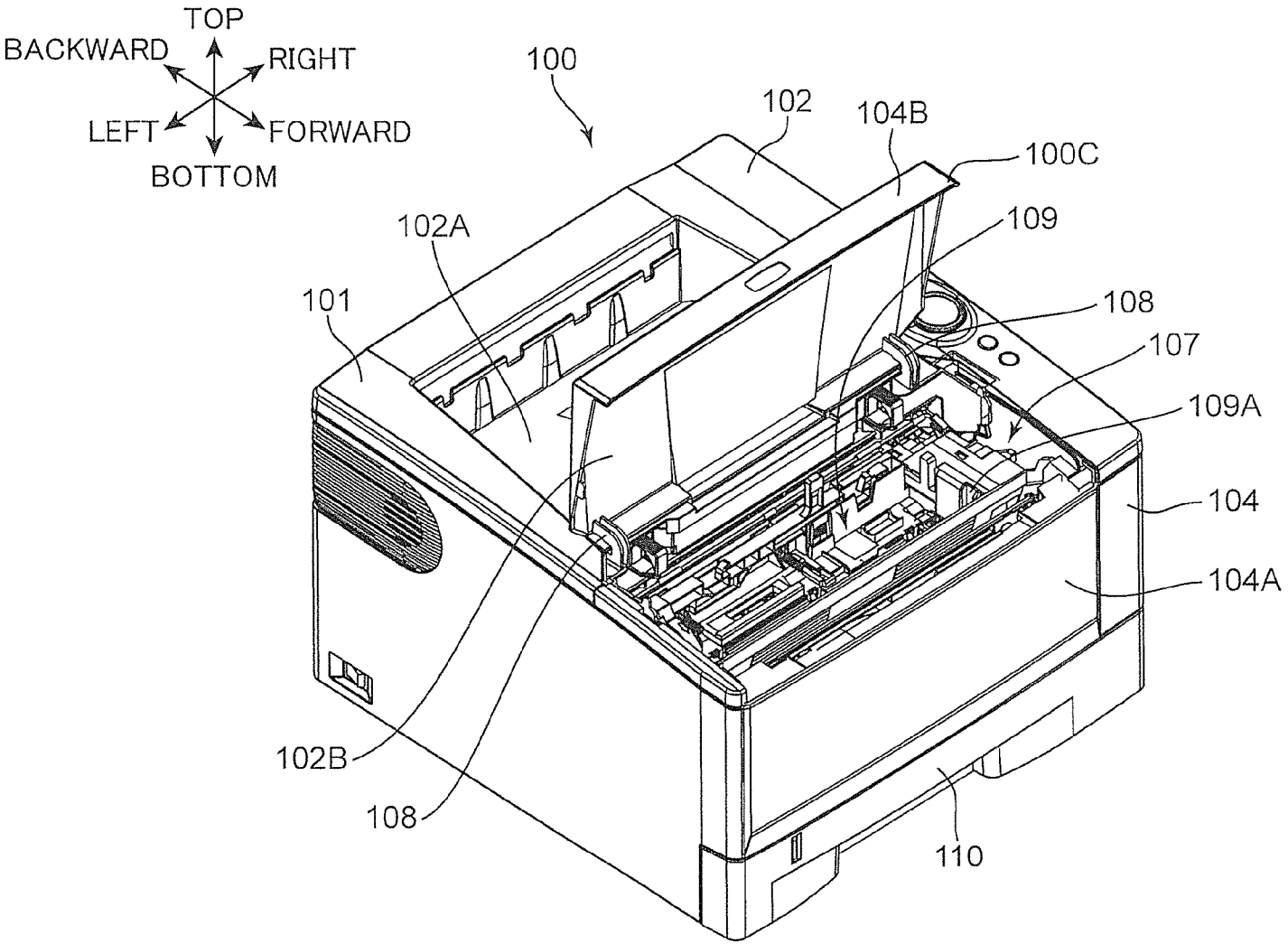
FIG. 2 is a perspective view of the image forming apparatus according to the embodiment of the present invention, a part of the apparatus being opened.
Figure 3:
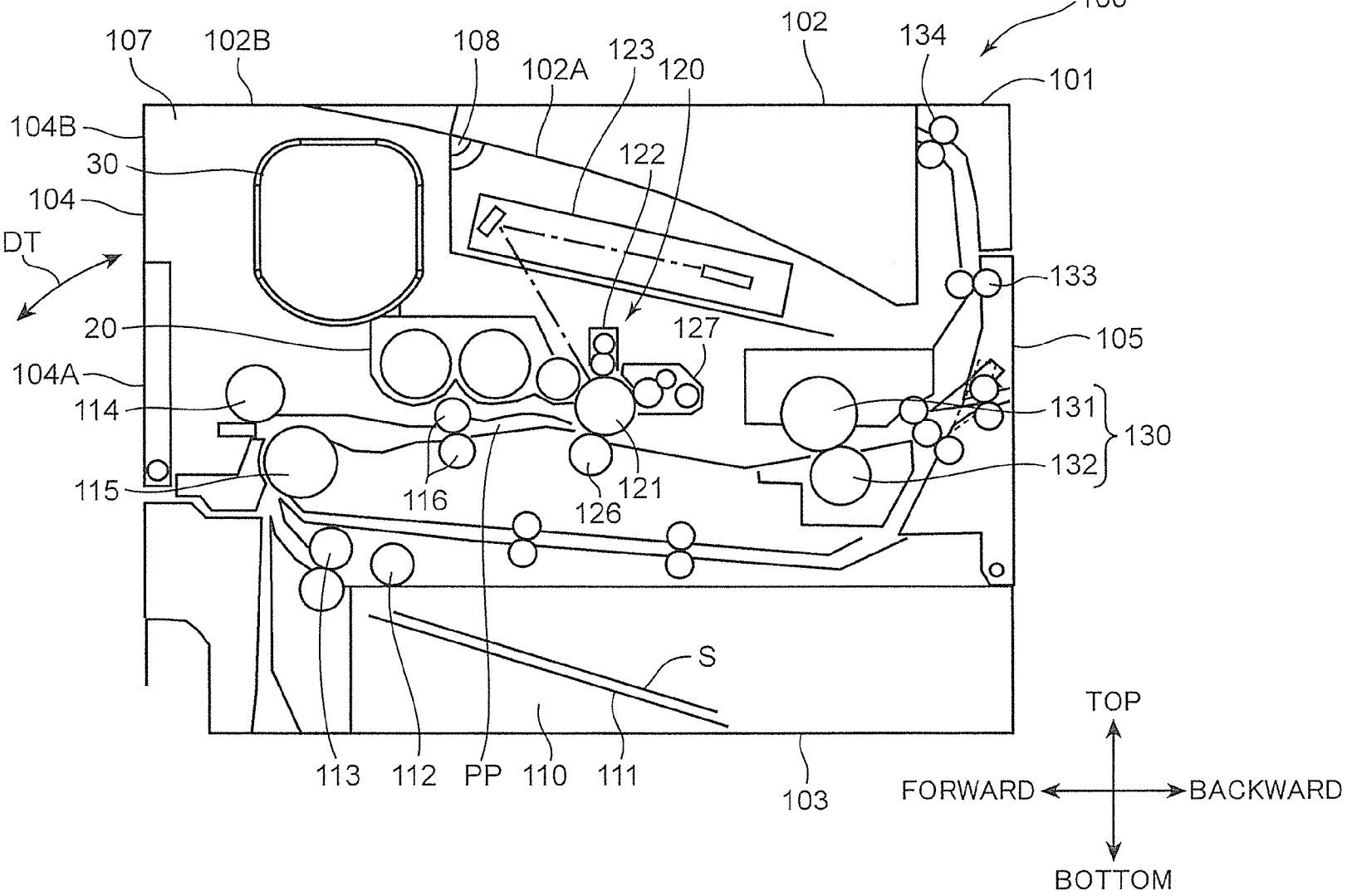
FIG. 3 is a schematic sectional view showing an internal structure of the image forming apparatus according to the embodiment of the present invention.

Hereinafter, an embodiment of the present invention will be described with reference to the accompanying drawings. FIGS. 1 and 2 are perspective views of a printer 100 (image forming apparatus) according to an embodiment of the present invention. FIG. 3 is a schematic sectional view showing an internal structure of the printer 100 shown in FIGS. 1 and 2. The printer 100 shown in FIGS. 1 to 3, which exemplifies the image forming apparatus, is configured as a so-called monochrome printer. However, other apparatuses may alternatively be provided as an image forming apparatus in other embodiments, such as a color printer, a facsimile apparatus or a multifunctional apparatus equipped with these functions, or another type of apparatus for forming a toner image on a sheet. It should be noted that hereinafter, terms indicating directions such as "top" "bottom" "forward" "backward" "left" and "right" are intended merely for descriptive purposes, and not for limiting the principle of the image forming apparatus.

The printer 100 includes a housing 101 for housing various components that are used for forming an image on a sheet S. The housing 101 includes a top wall 102 defining the top surface of the housing 101, a bottom wall 103 (FIG. 3) defining the bottom surface of the housing 101, a main body rear wall 105 (FIG. 3) connecting the top wall 102 and the bottom wall 103, and a main body front wall 104 located in front of the main body rear wall 105. The housing 101 includes a main body internal space 107 where various components are placed. A sheet conveyance passage PP extends in the main body internal space 107 of the housing 101, the sheet conveyance passage PP for allowing passage of a sheet S in a given conveying direction. Further, the printer 100 includes an opening/closing cover 100C mounted on the housing 101 in an openable and closable manner.

The opening/closing cover 100C includes a front wall upper portion 104B constituting an upper portion of the main body front wall 104, and a top wall front portion 102B constituting a front portion of the top wall 102. The opening/closing cover 100C can be vertically opened and closed with unillustrated hinge shafts acting as a fulcrum, the hinge shafts being respectively disposed on a pair of arms 108 disposed at lateral opposite ends of the opening/closing cover 100C (FIG. 2). When the opening/closing cover 100C is open, the main body internal space 107 is exposed to the outside at the top thereof. On the other hand, when the opening/closing cover 100C is closed, the main body internal space 107 is closed at the top thereof.

A sheet discharge section 102A is disposed in a central part of the top wall 102. The sheet discharge section 102A includes an oblique surface sloping downward from a front end to a rear end of the top wall 102. A sheet S that has been subjected to image formation in an image forming section 120 described later is discharged onto the sheet discharge section 102A. Further, a manual feed tray 104A is disposed in a vertically central part of the main body front wall 104. The manual feed tray 104A is vertically pivotable with a lower end thereof acting as a fulcrum (in the direction of an arrow DT shown in FIG. 3).

With reference to FIG. 3, the printer 100 includes a cassette 110, a pickup roller 112, a first sheet feeding roller 113, a second sheet feeding roller 114, a conveying roller 115, a pair of registration rollers 116, the image forming section 120, and a fixing device 130.

The cassette 110 stores sheets S therein. The cassette 110 includes a lift plate 111. The lift plate 111 is tilted to lift the leading edges of the sheets S. The cassette 110 can be pulled out forwardly with respect to the housing 101.

The pickup roller 112 is disposed above the leading edges of sheets S lifted by the lift plate 111. The pickup roller 112 rotates to draw a sheet S from the cassette 110.

The first sheet feeding roller 113 is disposed downstream of the pickup roller 112 and conveys a sheet S further downstream. The second sheet feeding roller 114 is disposed at the inner side (rear side) of the fulcrum of the manual feed tray 104A and draws a sheet placed on the manual feed tray 104A into the housing 101.

The conveying roller 115 is disposed downstream of the first sheet feeding roller 113 and the second sheet feeding roller 114 in their sheet conveying direction (hereinafter, the sheet conveying direction also being simply referred to as "conveying direction", and the downstream in the sheet conveying direction also being simply referred to as "downstream"). The conveying roller 115 conveys a sheet S fed by the first sheet feeding roller 113 or the second sheet feeding roller 114 further downstream.

The pair of registration rollers 116 functions to correct the angle of a sheet S that has been obliquely conveyed. This makes it possible to adjust the position of an image to be formed on the sheet S. The pair of registration rollers 116 supplies the sheet S to the image forming section 120 in accordance with timing of image formation to be performed by the image forming section 120.

The image forming section 120 includes a photoconductive drum 121 (image carrier), a charger 122, an exposure device 123, a developing device 20, a toner container 30 (developer container), a transferring roller 126 (transfer section), and a cleaning device 127.

The photoconductive drum 121 is in the form of a cylinder. The photoconductive drum 121 has a surface to be formed with an electrostatic latent image, and carries a toner image (developed image) corresponding to the electrostatic latent image on the surface. The charger 122 is applied with a predetermined voltage, and charges the circumferential surface of the photoconductive drum 121 substantially uniformly.

The exposure device 123 irradiates the circumferential surface of the photoconductive drum 121 charged by the charger 122 with beams of laser light. The beams of laser light are emitted in accordance with image data output from an external device (not shown) such as a personal computer which is communicably connected to the printer 100. Consequently, the circumferential surface of the photoconductive drum 121 is formed with an electrostatic latent image corresponding to the image data.

The developing device 20 supplies toner to the circumferential surface of the photoconductive drum 121, the circumferential surface being formed with an electrostatic latent image. The toner container 30 supplies toner to the developing device 20. The toner container 30 is detachably attached to the developing device 20. The developing device 20 supplies the toner to the photoconductive drum 121 to develop (visualize) the electrostatic latent image formed on the circumferential surface of the photoconductive drum 121. Consequently, the circumferential surface of the photoconductive drum 121 is formed with a toner image (developed image).

The transferring roller 126 is disposed below and opposite the photoconductive drum 121 across the sheet conveyance passage PP. The transferring roller 126 defines a transfer nip N in cooperation with the photoconductive drum 121 for transferring a toner image onto a sheet S.

The cleaning device 127 removes, after a toner image is transferred onto a sheet S from the circumferential surface of the photoconductive drum 121, toner remaining on the circumferential surface.

The fixing device 130 is disposed downstream of the image forming section 120 in the conveying direction, and fixes a toner image on a sheet S. The fixing device 130 includes a heating roller 131 for melting toner on the sheet S, and a pressure roller 132 for bringing the sheet S into close contact with the heating roller 131.

The printer 100 further includes a pair of conveying rollers 133 disposed downstream of the fixing device 130, and a pair of discharge rollers 134 disposed downstream of the pair of conveying rollers 133. A sheet S is conveyed upward by the pair of conveying rollers 133 to be finally discharged from the housing 101 by the pair of discharge rollers 134. The sheet S discharged from the housing 101 is placed on the sheet discharge section 102A, thereby resulting in a stack of sheets.

<Developing Device>

Figure 4:
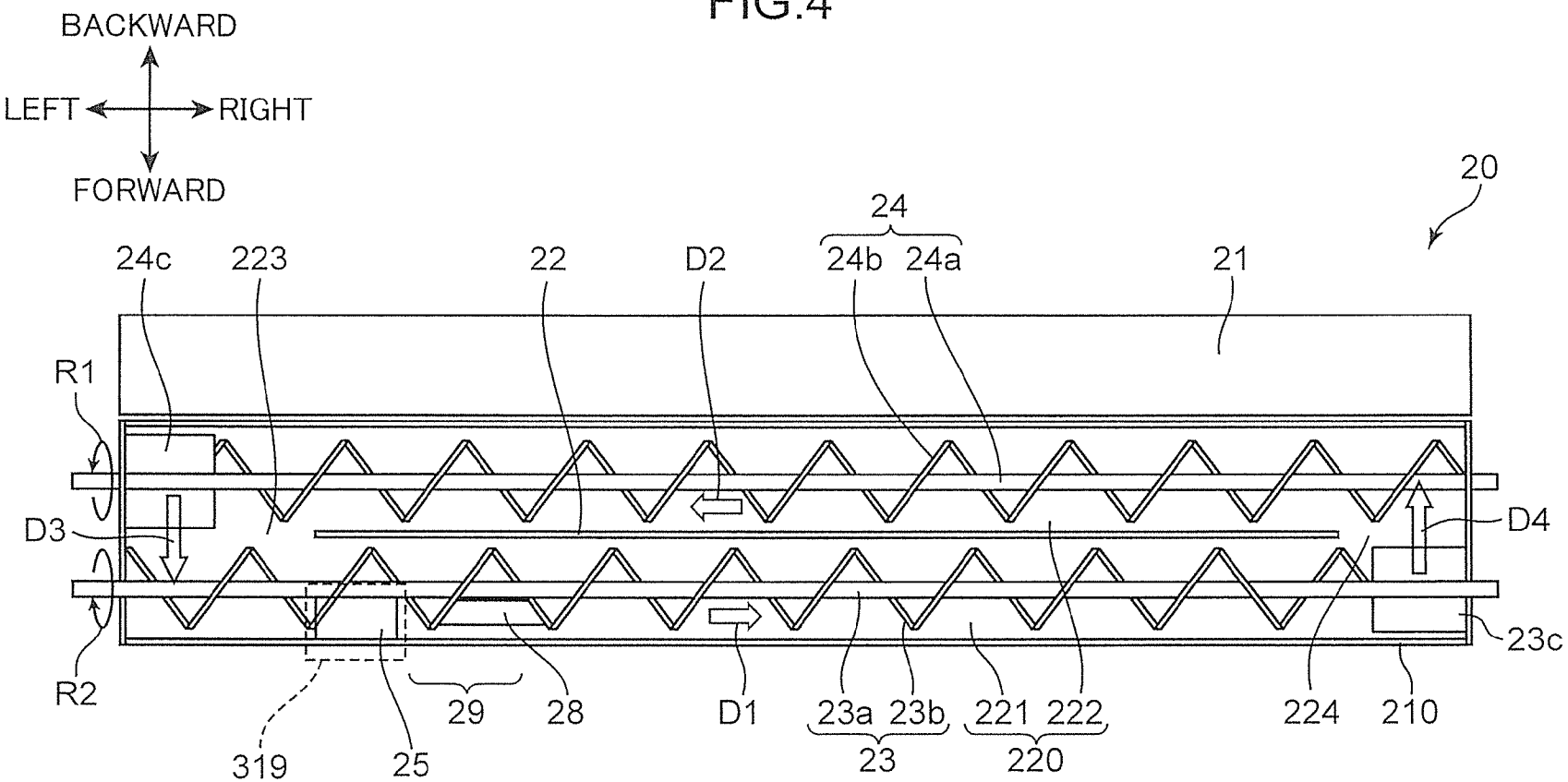
FIG. 4 is a schematic plan view showing an internal structure of a developing device according to the embodiment of the present invention.

FIG. 4 is a plan view showing an internal structure of the developing device 20. The developing device 20 includes a development housing 210 in the form of a box having a longer dimension in a specific direction (an axial direction of a developing roller 21 or a left-right direction). The development housing 210 includes a storage space 220. In the storage space 220, there are disposed the developing roller 21, a first stirring screw 23, a second stirring screw 24, and a toner supply port 25. The present embodiment employs a one-component developing method and, therefore, the storage space 220 is filled with toner that is to be used as developer. On the other hand, in the case of a two-component developing method, a mixture of toner and carrier including a magnetic material is filled as developer. The toner is circulatively conveyed in the storage space 220 and successively supplied from the developing roller 21 to the photoconductive drum 121 in order to develop an electrostatic latent image.

The developing roller 21 is in the form of a cylinder extending in a longitudinal direction of the development housing 210, and includes a sleeve constituting a circumferential portion of the developing roller 21 which is operable to be rotationally driven.

The storage space 220 of the development housing 210 is covered by an unillustrated top portion and divided, by a partition plate 22 extending in the left-right direction, into a first conveyance passage 221 and a second conveyance passage 222 having a longer dimension in the left-right direction. The partition plate 22 is shorter than the lateral width of the development housing 210 to define a first communication passage 223 and a second communication passage 224 respectively at the left and right sides of the partition plate 22, the first and second communication passages 223 and 224 allowing communication between the first conveyance passage 221 and the second conveyance passage 222. Consequently, there is a circulation passage constituted by the first conveyance passage 221, the second communication passage 224, the second conveyance passage 222, and the first communication passage 223 in the storage space 220. Toner is conveyed through the circulation passage counterclockwise in FIG. 4.

The toner supply port 25 (developer receiving port) is an opening formed in the top portion, and is disposed above and near a left end of the first conveyance passage 221. The toner supply port 25 faces the above-mentioned circulation passage, and functions to allow replenishment toner (replenishment developer) supplied from the toner container 30 to flow into the storage space 220.

The first stirring screw 23 is disposed in the first conveyance passage 221. The first stirring screw 23 includes a first rotary shaft 23*a*, and a first spiral blade 23*b* (screw blade) in the form of a spiral protrusion formed on the circumferential surface of the first rotary shaft 23*a*. The first stirring screw 23 is driven to rotate around the axis of the first rotary shaft 23*a* (in the direction of an arrow R2) to convey toner in the direction of an arrow D1 shown in FIG. 4. The first stirring screw 23 conveys toner so that the toner passes through a portion of the first conveyance passage 221 that faces the toner supply port 25. Thus, the first stirring screw 23 functions to convey and mix toner having been conveyed from the second conveyance passage 222 with new toner flowing in from the toner supply port 25 in the first conveyance passage 221. A first paddle 23*c* is disposed in a downstream part of the first stirring screw 23 in the toner conveying direction (in the arrow D1 direction). The first paddle 23*c* is configured by a plate-like member disposed on the first rotary shaft 23*a*. The first paddle 23*c* is rotated with the first rotary shaft 23*a* to deliver toner from the first conveyance passage 221 to the second conveyance passage 222 in the direction of an arrow D4 shown in FIG. 4.

The second stirring screw 24 is disposed in the second conveyance passage 222. The second stirring screw 24 includes a second rotary shaft 24*a*, and a second spiral blade 24*b* in the form of a spiral protrusion formed on the circumferential surface of the second rotary shaft 24*a*. The second stirring screw 24 is driven to rotate around the axis of the second rotary shaft 24*a* (in the direction of an arrow R1) to supply toner to the developing roller 21 while conveying toner in the direction of an arrow D2 shown in FIG. 4. A second paddle 24*c* is disposed in a downstream part of the second stirring screw 24 in the toner conveying direction (in the arrow D2 direction). The second paddle 24*c* is rotated with the second rotary shaft 24*a* to deliver toner from the second conveyance passage 222 to the first conveyance passage 221 in the direction of an arrow D3 shown in FIG. 4.

The toner container 30 (FIG. 3) is disposed above the toner supply port 25 of the development housing 210. The toner container 30 includes a toner discharge port 319 (FIG. 4). The toner discharge port 319 is disposed at a bottom portion 311 (FIG. 6) of the toner container 30 and corresponds to the toner supply port 25 of the development housing 20. Toner falling through the toner discharge port 319 passes through the toner supply port 25 to be supplied to the development device 20.

<Supply of Toner>

Figure 5:
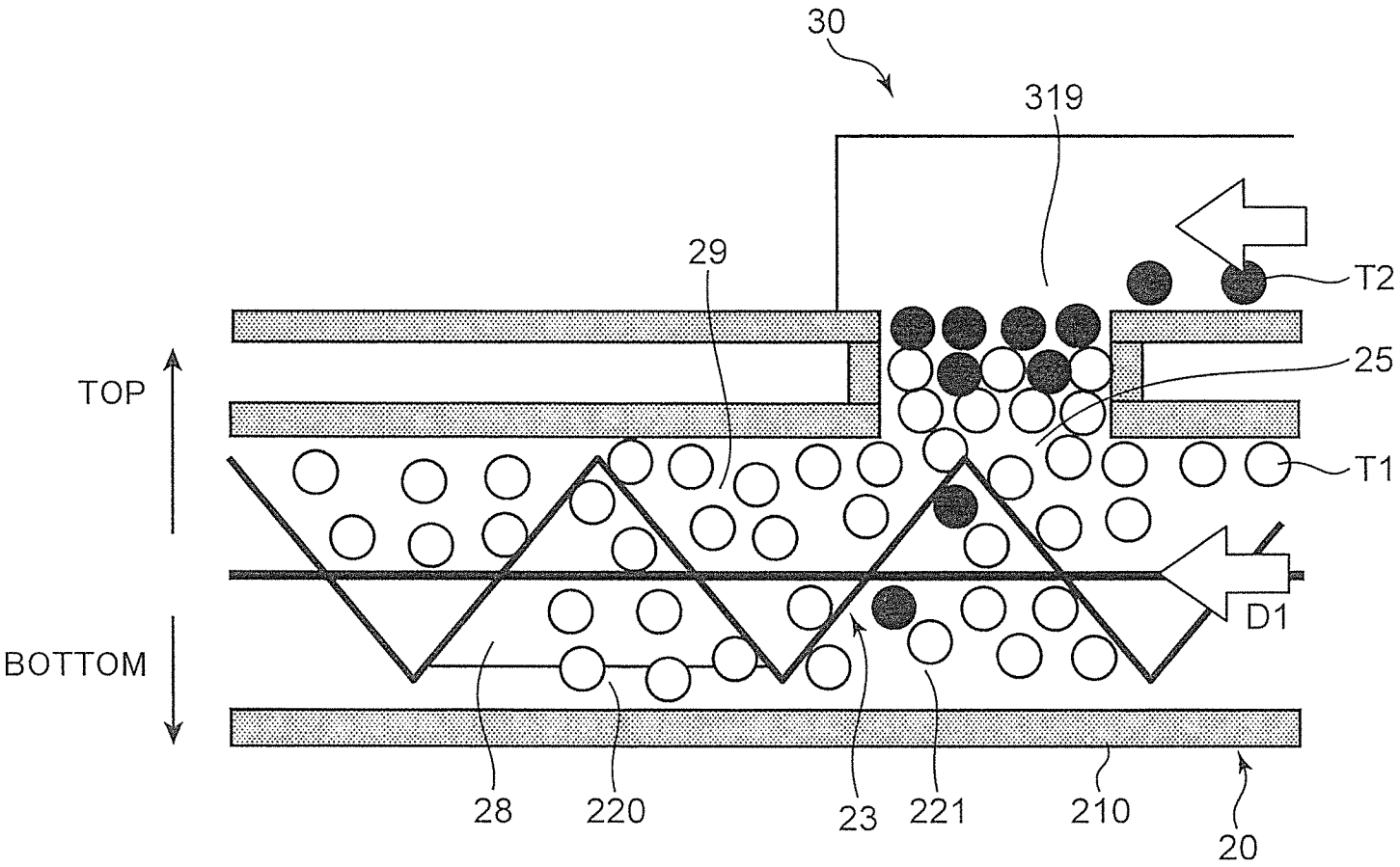
FIG. 5 is a schematic sectional view illustrating supply of developer to the developing device according to the embodiment of the present invention.

Now, there will be described a flow of toner that is newly supplied through the toner supply port 25. FIG. 5 is a sectional view showing the vicinity of the toner supply port 25 disposed in the developing device 20 and the toner discharge port 319 disposed in the toner container 30.

Replenishment toner T2 being supplied through the toner discharge port 319 of the toner container 30 falls into the first conveyance passage 221 to be mixed with existing toner T1, and the mixture of toners T1 and T2 are conveyed in the arrow D1 direction by the first stirring screw 23. At this time, the toners T1 and T2 are stirred and charged.

The first stirring screw 23 includes a reducing paddle 28 (conveying ability reducing portion) disposed downstream of the toner supply port 25 in the toner conveying direction, the reducing paddle for partially reducing the ability of conveying toner. In the present embodiment, the reducing paddle 28 is configured by a plate-like member extending between a particular advancing point and a particular receding point of a turn of the first spiral blade 23*b* of the first stirring screw 23. The reducing paddle 28 rotates with the first rotary shaft 23*a* to cause toner being conveyed from the upstream side of the reducing paddle 28 to begin to accumulate. The accumulation of toner grows up to immediately upstream of the reducing paddle 28, that is, a portion where the toner supply port 25 faces the first conveyance passage 221. As a result, a tonner accumulation portion 29 (developer accumulation portion) appears near the inlet of the toner supply port 25.

When the amount of toner in the storage space 220 increases as a result of the supply of replenishment toner T2 though the toner supply port 25, the toner of the accumulation portion 29 covers (seals) the toner supply port 25, which prevents further toner supply. Thereafter, as the toner of the accumulation portion 29 decreases due to consumption of toner in the storage space 220 by the developing roller 21, the amount of toner covering the toner supply port 25 decreases such that a gap appears between the accumulation portion 29 and the toner supply port 25. This allows new inflow of replenishment toner T2 into the storage space 220 through the toner supply port 25. As described, the present embodiment employs the volume replenishment type toner supply method in which the amount of replenishment toner to be received is adjusted according to the decrease in the amount of toner of the accumulation portion 29.

<Structure of Toner Container>

Figure 6:
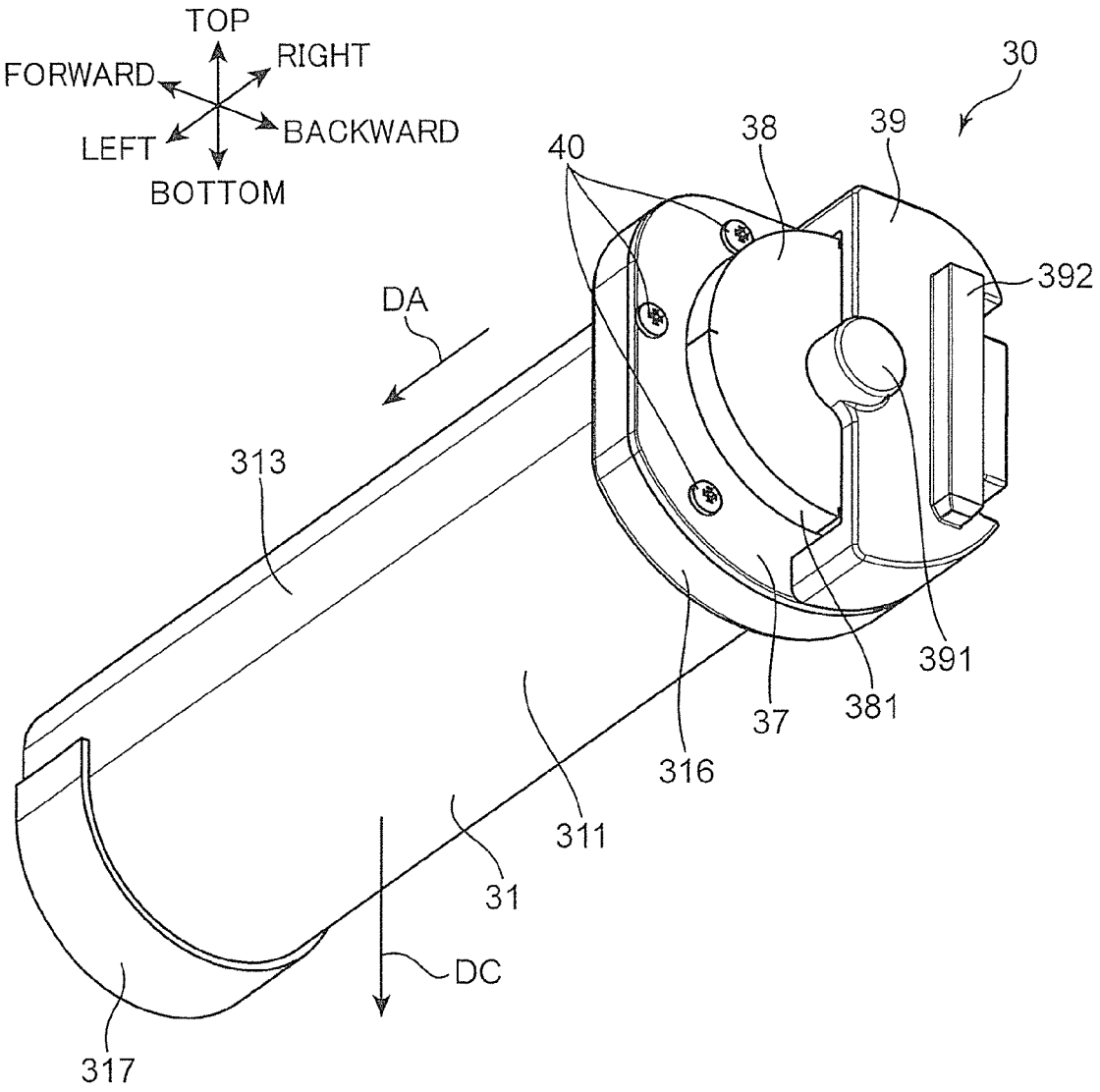
FIG. 6 is a perspective view of a developer container according to a first embodiment of the present invention.
Figure 7:
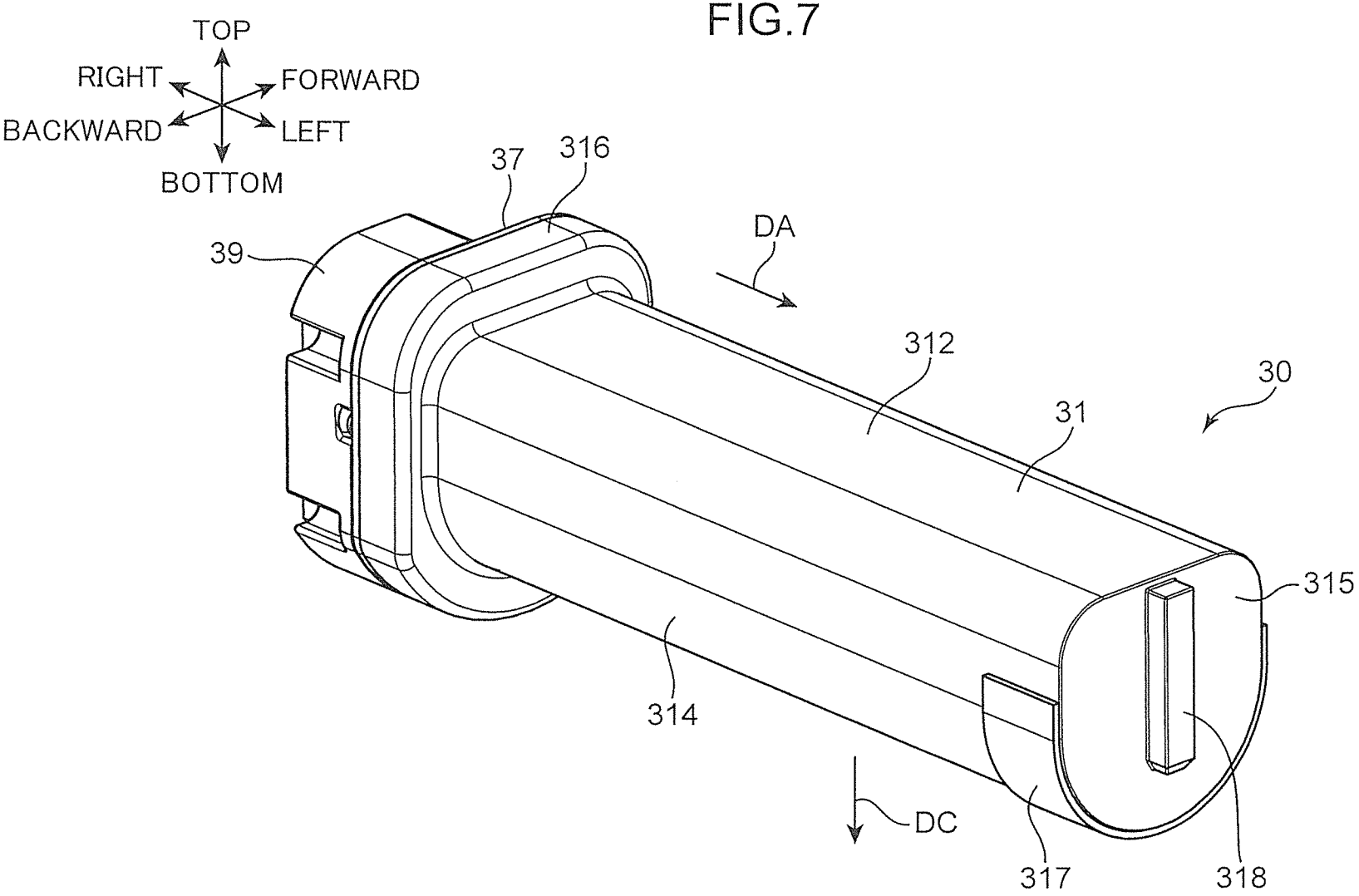
FIG. 7 is a perspective view of the developer container according to the first embodiment of the present invention.
Figures 8A, 8B, 8C:
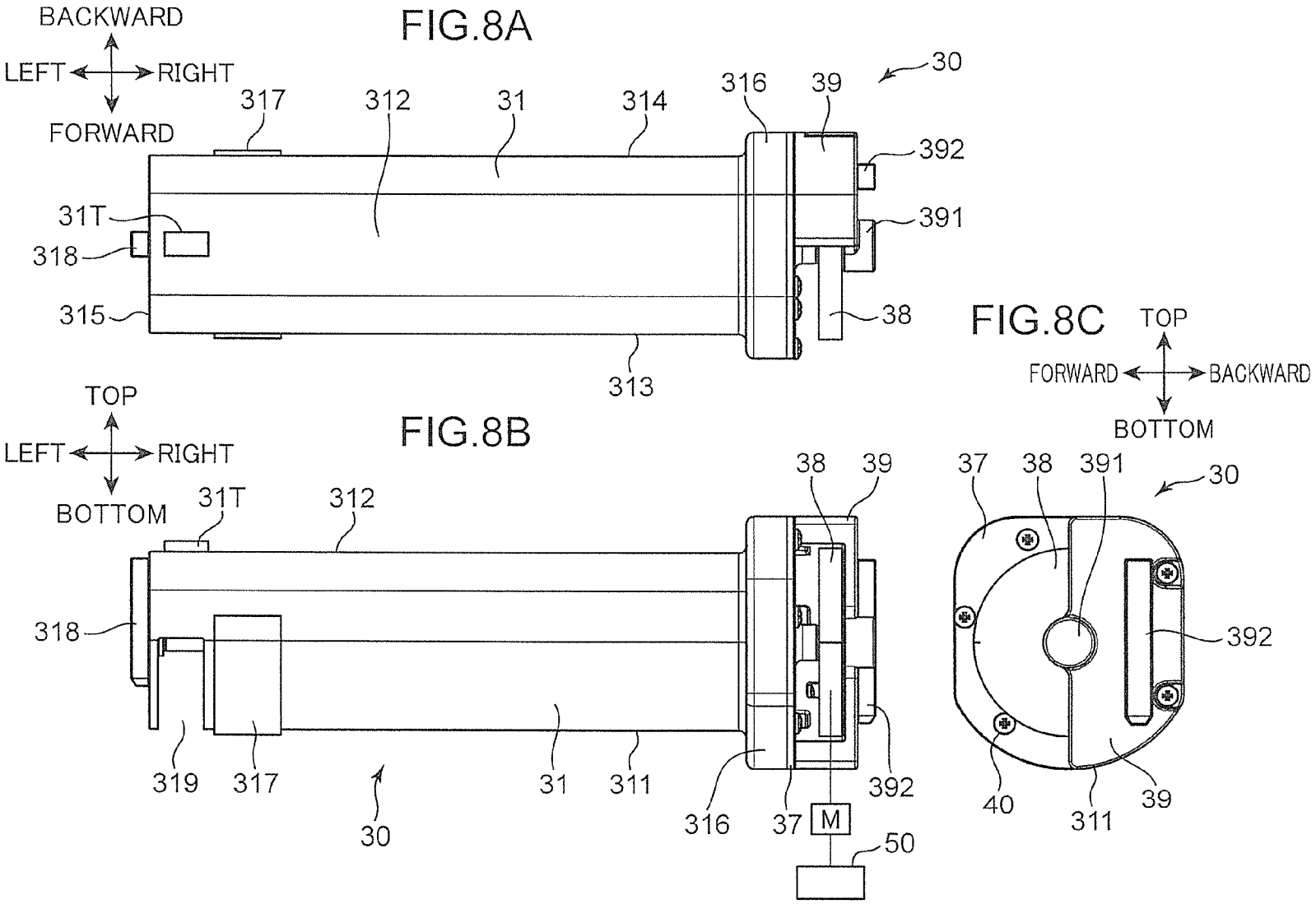
FIG. 8A is a plan view of the developer container according to the first embodiment of the present invention.
FIG. 8B is a front view of the developer container according to the first embodiment of the present invention.
FIG. 8C is a side view of the developer container according to the first embodiment of the present invention.
Figure 9:
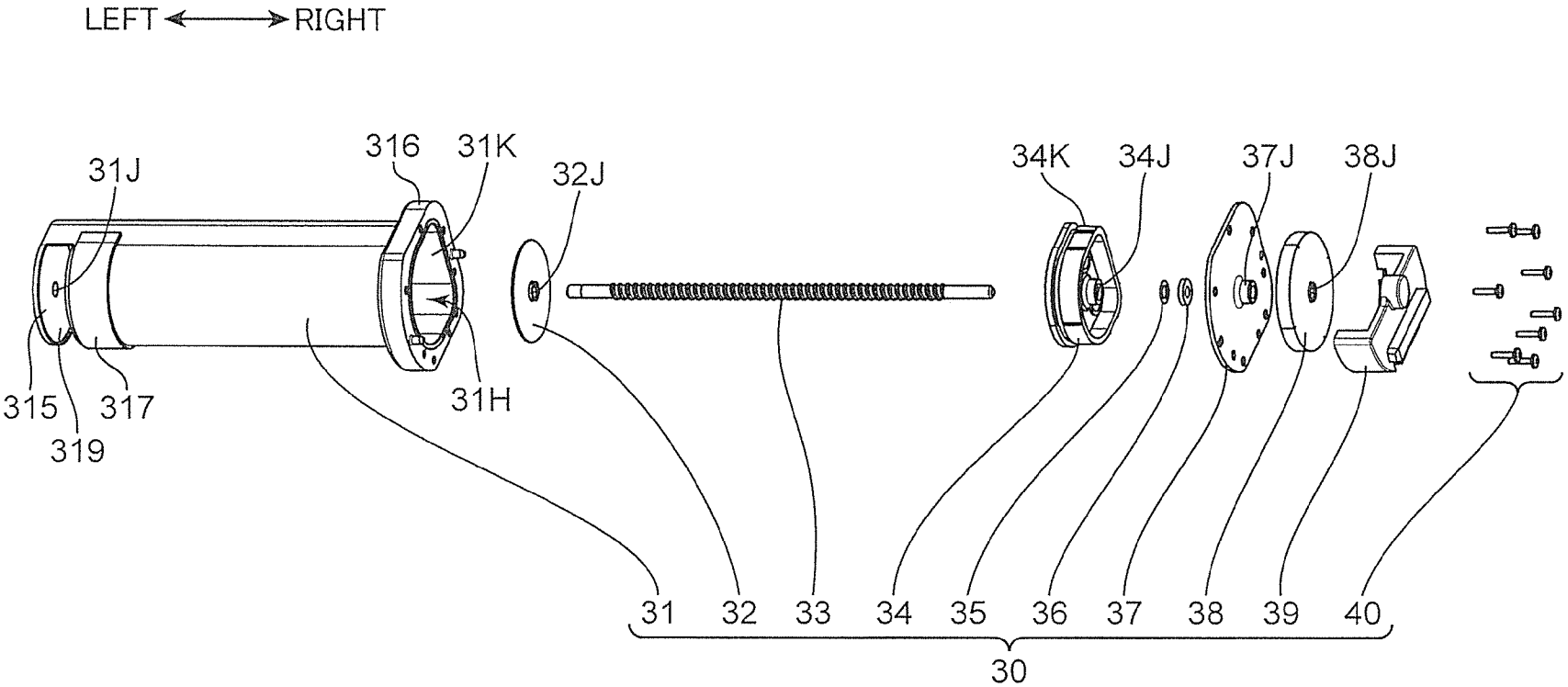
FIG. 9 is an exploded perspective view of the developer container according to the first embodiment of the present invention.
Figure 10B:
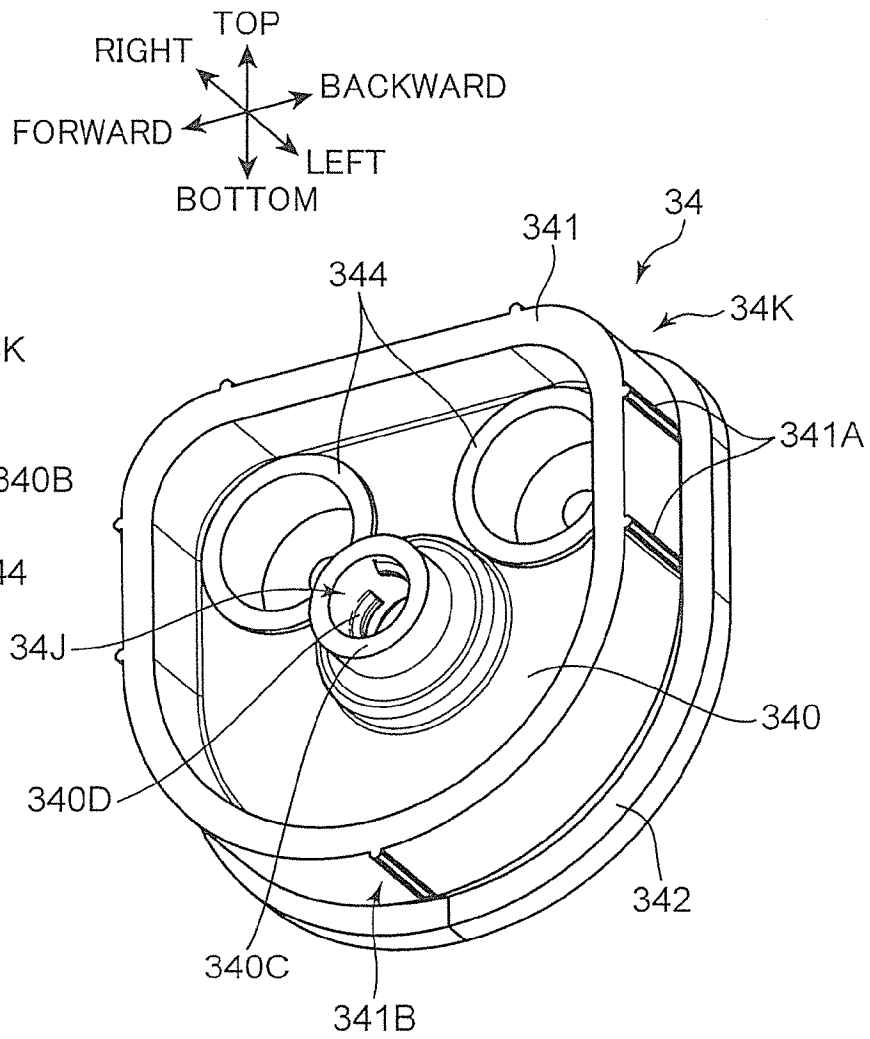
FIG. 10B is a perspective view of the movable wall of the developer container according to the first embodiment of the present invention.
Figure 10A:
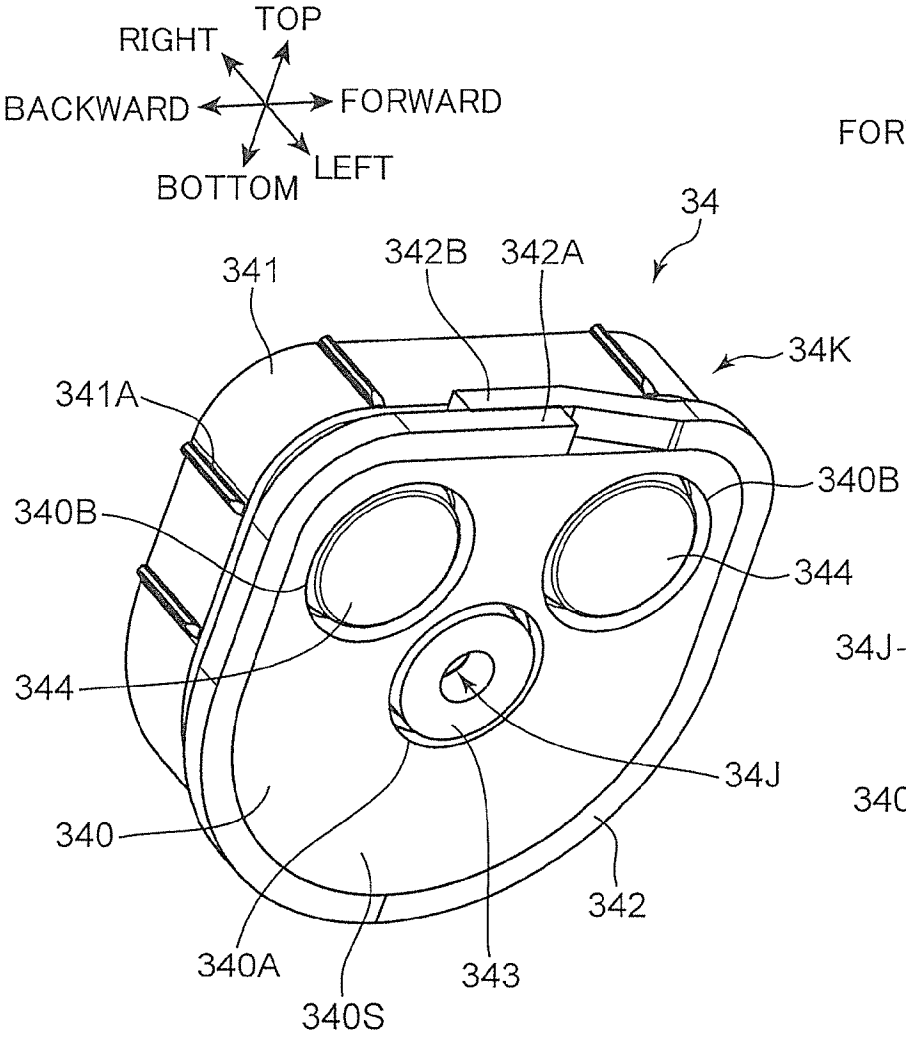
FIG. 10A is a perspective view of a movable wall of the developer container according to the first embodiment of the present invention.
Figure 11:
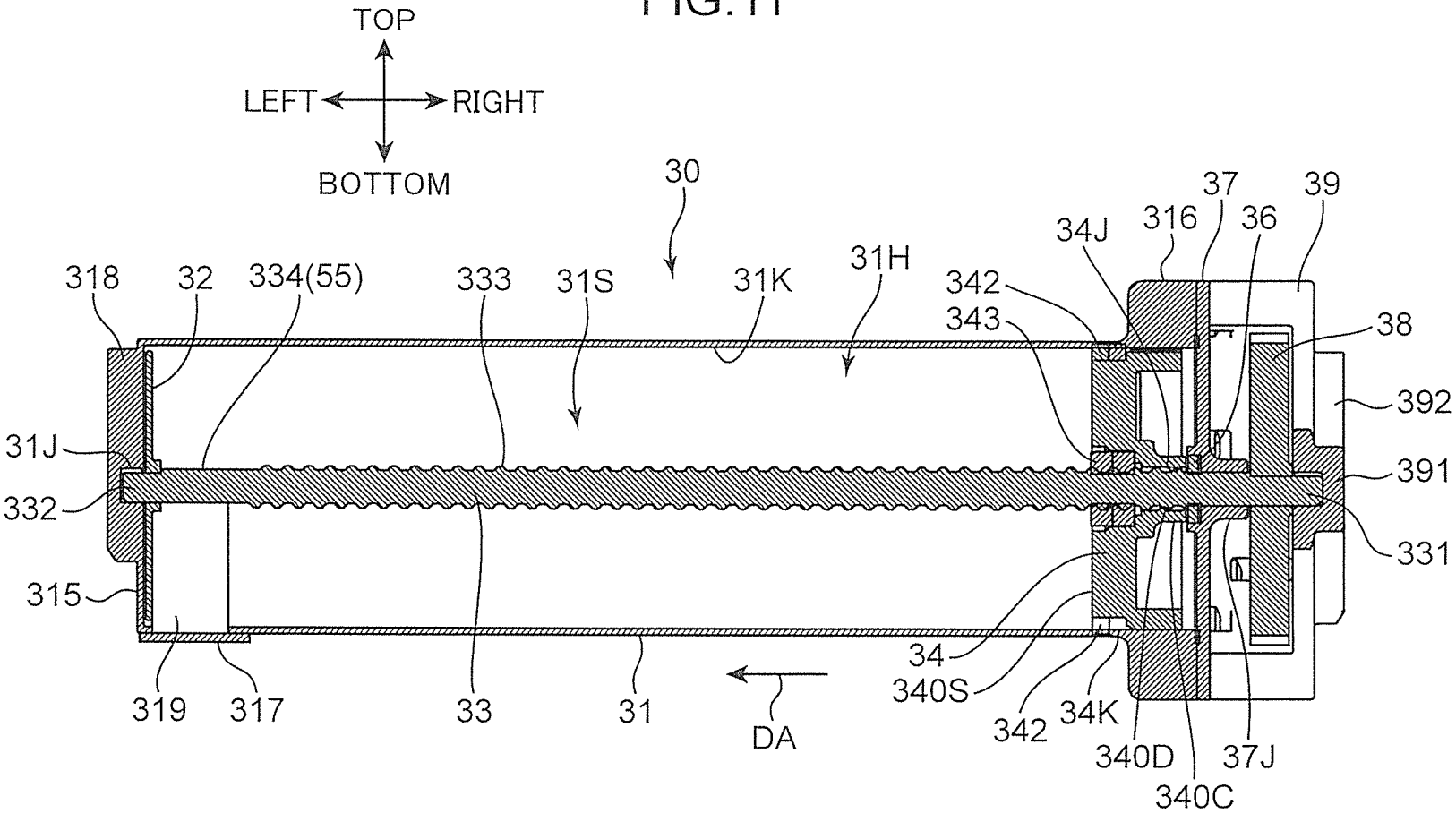
FIG. 11 is a sectional view of the developer container according to the first embodiment of the present invention.

Now there will be described a toner container 30 (developer container) according to a first embodiment of the present invention with reference to FIGS. 6 to 11. FIGS. 6 and 7 are perspective views of the toner container 30 according to the present embodiment. FIG. 8A is a plan view of the toner container 30, FIG. 8B is a front view of the toner container 30, and FIG. 8C is a side view of the toner container 30. FIG. 9 is an exploded perspective view of the toner container 30. FIGS. 10A and 10B are perspective views of a movable wall 34 of the toner container 30. FIG. 11 is a sectional view of the toner container 30.

The toner container 30 is substantially in the form of a cylinder. The toner container 30 contains replenishment toner (developer). With reference to FIGS. 9 and 11, the toner container 30 includes a container body 31 (container body), a stirring disc 32, a shaft 33 (shaft), the movable wall 34, a washer 35 (FIG. 9), a sponge seal 36, a lid 37, a rotary gear 38 (drive transmitter), a cover 39, and screws 40 (FIG. 9).

The container body 31 constitutes the body of the toner container 30 and is substantially in the form of a cylinder. The container body 31 includes an inner circumferential portion 31K (inner surface) and an internal space 31H (FIGS. 9 and 11). The inner circumferential portion 31K is defined by the inner surface of the container body 31. The internal space 31H is in the form of a cylinder extending in a longitudinal direction (in a first direction, the direction of an arrow DA shown in FIGS. 6, 7, and 11) and is defined by the inner circumferential portion 31K.

The container body 31 includes a bottom portion 311, a top portion 312, a front wall 313 (side wall), a rear wall 314 (side wall), a left wall 315 (wall portion), and a flange 316. The bottom portion 311 constitutes the bottom of the container body 31 and is in the form of a half cylinder projecting downward. In other words, the bottom portion 311 has an arc shape in sectional view perpendicularly intersecting the first direction. The front wall 313 and the rear wall 314 are a pair of side walls standing upward on the opposite lateral ends of the bottom portion 311. The top portion 312 is disposed above the bottom portion 311 to cover the internal space 31H from above. The left wall 315 joins one end (left end) of each of the bottom portion 311, the front wall 313, the rear wall 314, and the top portion 312 in the first direction, thereby covering the container body 31. The internal space 31H is defined by the bottom portion 311, the top portion 312, the front wall 313, the rear wall 314, and the left wall 315, and also by the lid 37 described later. The internal space 31H includes a storage space 31S defined between the left wall 315 and the movable wall 34 described later. The storage space 31S is a space where toner is contained in the toner container 30.

As shown in FIG. 9, the container body 31 is open at an end thereof that is opposite to the left wall 315 in the first direction. The flange 316 defines this opening and has an outer diameter greater than that of the opposite end of the container body 31 in the first direction. The flange 316 is attached with the lid 37 described later.

The container body 31 includes a shutter 317, a first guiding portion 318, and a toner discharge port 319 (developer discharge port). The shutter 317 is disposed at one end of the container body 31 in the first direction. The shutter 317 can be slid in the first direction. The shutter 317 closes (seals) the toner discharge port 319 from the outside of the container body 31, and exposes the toner discharge port 319 to the outside.

The first guiding portion 318 is in the form of a protrusion vertically extending on the outer surface of the left wall 315. The first guiding portion 318 guides mounting of the toner container 30 into the housing 101 in cooperation with a second guiding portion 392 described later.

The toner discharge port 319 is an opening formed in a lower part of the inner circumferential portion 31K of the container body 31 and communicates with the internal space 31H (storage space 31S). As shown in FIGS. 8B and 9, the toner discharge port 319 is formed at the one end of the container body 31 in the first direction. Further, the toner discharge port 319 is formed along the arc shape of the bottom portion 311 and having a predetermined width in the first direction. Toner contained in the storage space 31S is discharged through the toner discharge port 319 toward the developing device 20. In the present embodiment, as described above, the internal space 31H of the container body 31 is defined by the bottom portion 311, the front wall 313, the rear wall 314, and the top portion 312. Therefore, the toner in the storage space 31S concentrates at a mid-portion of the arc-shaped bottom portion 311 by its own weight. This allows the toner, which is conveyed by the movable wall 34 described later, to be efficiently discharged through the toner discharge port 319.

The stirring disc 32 (FIGS. 9 and 11) is configured by a plate member in the form of a disc. The stirring disc 32 is secured to a second shaft end portion 332 of the shaft 33 described later, and rotates integrally with the shaft 33. The stirring disc 32 is disposed along the left wall 315 in the storage space 31S of the container body 31. The stirring disc 32 functions to stir toner existing over the toner discharge port 319.

The shaft 33 is disposed in the internal space 31H and extends in the first direction, the shaft 33 being rotatably supported on the container body 31 and the lid 37 described later. The shaft 33 includes a first shaft end portion 331, the second shaft end portion 332, a male thread 333 (first engaging portion), and a movable wall stopper portion 334.

The first shaft end portion 331 (FIG. 11) is defined by one end of the shaft 33 in the first direction. The first shaft end portion 331 is axially supported in a lid shaft hole 37J of the lid 37 described later. The second shaft end portion 332 is defined by the other end of the shaft 33 in the first direction. The second shaft end portion 332 is axially supported in a main body bearing 31J (FIG. 11) formed in the left wall 315 of the container body 31. The male thread 333 is in the form of a helical ridge projecting from the outer surface of the shaft 33 in the internal space 31H. In the present embodiment, the male thread 333 extends on the shaft 33 from a position facing the flange 316 to a position immediately preceding the toner discharge port 319, as shown in FIG. 11. The movable wall stopper portion 334 is disposed downstream of the male thread 333 in the first direction. The movable wall stopper portion 334 is defined by a specific part of the shaft 33, the specific part not bearing the male thread 333. The movable wall stopper portion 334 is disposed above the toner discharge port 319.

The movable wall 34 is disposed in the container body 31 and in the form of a wall extending in a direction perpendicularly intersecting the first direction. The movable wall 34 defines one end surface (right end surface) of the storage space 31S in the first direction. The other end surface (left end surface) of the storage space 31S in the first direction is defined by the left wall 315 and the stirring disc 32. The movable wall 34 is moved to the toner discharge port 319 in the first direction from a right end side toward a left end side of the internal space 31H while conveying toner contained in the storage space 31S to the toner discharge port 319, during a time period from the beginning of use to the end of use of the toner container 30. The movable wall 34 can be moved only in the left direction by a motor M described later.

With reference to FIGS. 10A and 10B, the movable wall 34 includes a conveying wall portion 340, an outer peripheral wall portion 341, an inner wall seal 342 (sealing member), a shaft seal 343 (cleaning member), supply opening caps 344 (closing member), a movable wall shaft hole 34J, and an outer circumferential portion 34K (outer surface).

The conveying wall portion 340 defines the storage space 31S in cooperation with the inner circumferential portion 31K of the container body 31. In particular, the conveying wall portion 340 includes a conveying surface 340S extending in a direction perpendicular to the shaft 33. The conveying surface 340S conveys toner in the storage space 31S by pressing it in the movement of the movable wall 34. The conveying wall portion 340 further includes a bearing 340A, toner supply openings 340B (developer filling port), and a cylinder part 340C. The bearing 340A is formed in a substantially central part of the conveying wall portion 340. The bearing 340A moves in the first direction while holding the movable wall 34. The above-described shaft 33 is inserted in the bearing 340A. The toner supply openings 340B are formed above the bearing 340A and pass through the conveying wall portion 340 in the first direction. Upon attachment of the movable wall 34 to the container body 31, the toner supply openings 340B communicate with the storage space 31S. Replenishment toner is filled into the storage space 31S through the toner supply openings 340B when the toner container 30 is manufactured.

The cylinder part 340C projects from the surface of the conveying wall portion 340 that is opposite to the conveying surface 340S in the first direction. The cylinder part 340C constitutes a part of the bearing 340A. The cylinder part 340C includes a female thread 340D (second engaging portion). The female thread 340D is in the form of a helical ridge projecting from the inner surface of the cylinder part 340C. The female thread 340D functions to move the movable wall 34 in the first direction by engaging with the male thread 333 of the shaft 33. At this time, an inner wall of the cylinder part 340C comes into contact with an outer circumferential portion of the shaft 33, whereby the position of the movable wall 34 is maintained. Therefore, the conveying wall portion 340 of the movable wall 34 is prevented from tilting with respect to the shaft 33.

The outer peripheral wall portion 341 projects from an outer peripheral edge of the conveying wall portion 340 in a direction away from the storage space 31S, namely, in the direction opposite to the moving direction of the movable wall 34. The outer peripheral wall portion 341 faces the inner circumferential portion 31K of the container body 31. The outer peripheral wall portion 341 includes ribs 341A and a discharge port sealing part 341B. The ribs 341A are disposed on the outer peripheral wall portion 341 and extend in the first direction. The ribs 341A are spaced from one another in a circumferential direction of the outer peripheral wall portion 341. The ribs 341A are in slight contact with the inner circumferential portion 31K, and function to prevent the movable wall 34 from tilting in the first direction in the container body 31. The discharge port sealing part 341B is defined by a lowest part of the outer peripheral wall portion 341 and has a sufficient size to cover the toner discharge port 319.

The inner wall seal 342 is disposed on the outer peripheral wall portion 341 on a rear end joining the conveying wall portion 340 in such a way as to ride on a circumference of the rear end of the outer peripheral wall portion 341. As shown in FIG. 10A, the inner wall seal 342 is first secured to the top of the conveying wall portion 340 at a first seal end 342A thereof, and is then wound around the conveying wall portion 340 and finally secured at a second seal end 342B thereof in such a manner that the first seal end 342A and the second seal end 342B overlap each other. The inner wall seal 342 is resiliently compressed between the inner circumferential portion 31K of the container body 31 and the movable wall 34. The inner wall seal 342 defines the outer circumferential portion 34K of the movable wall 34. The outer circumferential portion 34K is slidably disposed in close contact with the inner circumferential portion 31K of the container body 31. The inner wall seal 342 prevents toner in the storage space 31S from flowing out to the upstream side of the movable wall 34 in the moving direction through the gap between the inner circumferential portion 31K of the container body 31 and the movable wall 34.

The shaft seal 343 is disposed on the bearing 340A at the downstream side of the female thread 340D in the moving direction of the movable wall 34 (FIG. 11). The shaft seal 343 comes in contact with the male thread 333 of the shaft 33 in the movement of the movable wall 34. At this time, the shaft seal 343 comes in contact with the male thread 333 before the female thread 340D to clean toner adhered on the male thread 333. This allows the male thread 333 to engage with the female thread 340D after toner adhered thereon is removed almost completely. Therefore, it is possible to prevent aggregation of toner between the male thread 333 and the female thread 340D and consequently allow a stabilized movement of the movable wall 34. Further, the shaft seal 343 is in the form of a ring, and therefore is in close contact with the shaft 33 over the entire circumference of the shaft 33 for sealing the bearing 340A. This prevents toner in the storage space 31S from flowing out to the upstream side of the movable wall 34 in the moving direction through the bearing 340A. The movable wall shaft hole 34J allowing the shaft 33 to pass therethrough is defined radially inside the shaft seal 343 being in the form of a ring and the cylinder part 340C.

The supply opening caps 344 are fitted in the toner supply openings 340B through the inside of the outer peripheral wall portion 341 to seal the toner supply openings 340B, as shown in FIG. 10B. After replenishment toner is filled in the container space 31S through the toner supply openings 340B, the supply opening caps 344 are respectively fitted into the toner supply openings 340B. Consequently, the toner is prevented from leaking through the toner supply openings 340B.

The washer 35 (FIG. 9) is disposed between the cylinder part 340C of the movable wall 34 and the sponge seal 36 and placed around the shaft 33.

The sponge seal 36 is disposed between the washer 35 and the lid 37. The sponge seal 36 prevents leakage of toner through the lid shaft hole 37J of the lid 37 described later, the lid 37 being secured to the container body 31.

The lid 37 (FIGS. 9 and 11) is secured to the flange 316 of the container body 31 and seals the opening of the container body 31. The lid 37 includes the lid shaft hole 37J. The shaft 33 is rotatably and axially supported in the lid shaft hole 37J at the first shaft end portion 331.

The rotary gear 38 is secured to the first shaft end portion 331 of the shaft 33. A distal end of the first shaft end portion 331 has a D-shape in sectional view perpendicularly intersecting its axial direction. The rotary gear 38 is formed with an unillustrated D hole in a central part thereof, the D hole engaging with the distal end of the first shaft end portion 331 having the D-shape. The rotary gear 38 rotates integrally with the shaft 33. The rotary gear 38 includes an outer peripheral gear portion 381. The outer peripheral gear portion 381 is defined by an outer peripheral portion of the rotary gear 38. The gear teeth of the outer peripheral gear portion 381 are not shown in the drawings. The rotary gear 38 is connected to the motor M (FIG. 8B) (driving source) disposed in the housing 101 of the printer 100. Upon receipt of a torque from the motor M, the rotary gear 38 transmits the torque to the shaft 33 to move the movable wall 34 in the first direction.

The cover 39 is disposed at an end of the toner container 30. With reference to FIG. 8C, the cover 39 has such a shape to cover a half of the circular side face of the rotary gear 38. In other words, when the cover 39 is secured to the container body 31 via the lid 37, a half of the circular side face of the rotary gear 38 is exposed to the outside of the toner container 30. The cover 39 includes a shaft cover portion 391 and the second guiding portion 392. The shaft cover portion 391 is formed in a central part of the cover 39 and is in the form of a cylinder. The shaft cover portion 391 covers the end of the first shaft end portion 331 projecting from the rotary gear 38. The second guiding portion 392 is disposed behind the shaft cover portion 391 and is in the form of a protrusion vertically extending. The second guiding portion 392 functions to guide mounting of the toner container 30 into the printer 100.

Each of the screws 40 is fastened to the flange 316 of the container body 31 after being inserted into unillustrated screw holes respectively formed in the lid 37 and the cover 39. Consequently, the container body 31, the lid 37, the rotary gear 38, and the cover 39 constitute an integral structure, with the stirring disc 32, the shaft 33, and the movable wall 34 being disposed in the internal space 31H.

Further, the toner container 30 includes a toner sensor 31T (FIGS. 8A and 8B). The toner sensor 31T is disposed on the top portion 312 of the container body 31 above the toner discharge port 319. The toner sensor 31T includes a magnetic permeability sensor or a piezoelectric element. In the case where the toner sensor 31T includes a piezoelectric element, a sensing portion of the toner sensor 31T is exposed to the storage space 31S. The toner sensor 31T outputs a HIGH signal (+5V) in response to being pressed by toner in the storage space 31S. Further, when no toner exists directly under the toner sensor 31T, the toner sensor 31T outputs a LOW signal (0V). A signal outputted by the toner sensor 31T is referred to by a controller 50 described later. In the case where the toner sensor 31T is configured as a magnetic permeability sensor, the sensor does not need to make direct contact with toner. Therefore, in other embodiments, the toner sensor 31T may be disposed on the housing 101 of the printer 100 and opposite an outer wall of the container body 31. Further, the toner sensor 31T is not limited to be disposed on the top portion 312. In other embodiments, the toner sensor may be disposed on any one of the bottom portion 311, the front wall 313, and the rear wall 314 of the container body 31. In the case where the toner sensor is disposed on a lowest part of the bottom portion 311, the toner discharge port 319 may be formed at a position circumferentially away from the lowest part.

<Function of Toner Container>

As described above, the toner container 30 can be attached to and detached from the developing device 20. With reference to FIG. 2, when the opening/closing cover 100C of the housing 101 is opened upward, a container housing space 109 is exposed to the outside of the housing 101, the container housing space 109 constituting a part of the main body internal space 107. In the present embodiment, the toner container 30 is mounted in the container housing space 109 from above (see an arrow DC shown in FIGS. 6 and 7). At this time, the cover 39 of the toner container 30 comes to rest at the right end of the container housing space 109, and the left wall 315 of the toner container 30 comes to rest at the left end of the container housing space 109. The printer 100 includes guide grooves 109A (FIG. 2). The guide grooves 109A are formed in the container housing space 109 and vertically extend. Although FIG. 2 shows only a right guide groove 109A, there is also a left guide groove 109A similarly disposed at the left end of the container housing space 109.

The toner container 30 is mounted in the container housing space 109 by a user, with the first guiding portion 318 and the second guiding portion 392 engaging with the pair of guide grooves 109A. After the toner container 30 is mounted in the container housing space 109, a user or an unillustrated opening/closing mechanism slides the shutter 317 to open the toner discharge port 319. Consequently, the toner discharge port 319 lies above and opposite the toner supply port 25 (FIGS. 4 and 5).

Figure 12A:
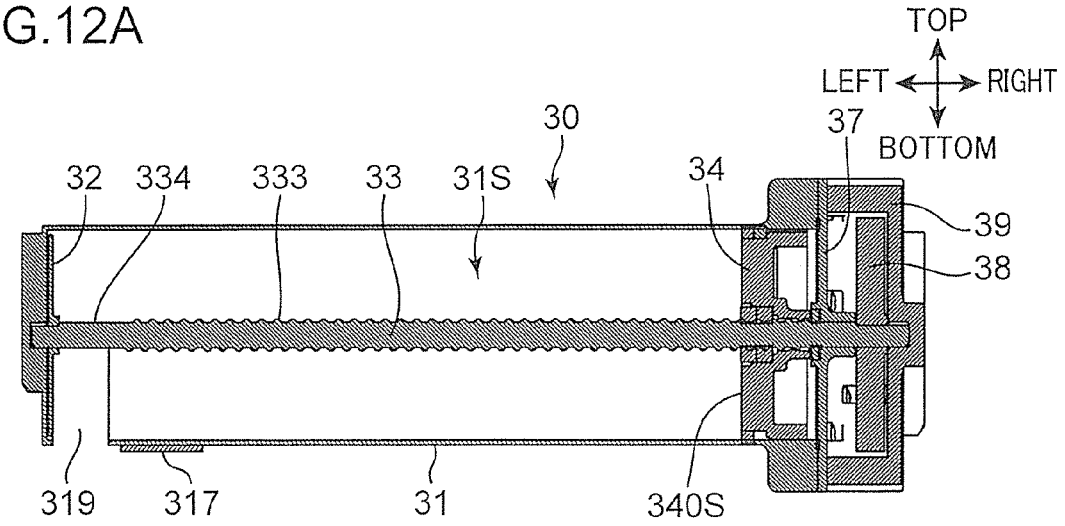
FIG. 12A is a sectional view illustrating a movement state of the movable wall in the developer container according to the first embodiment of the present invention.
Figure 12B:
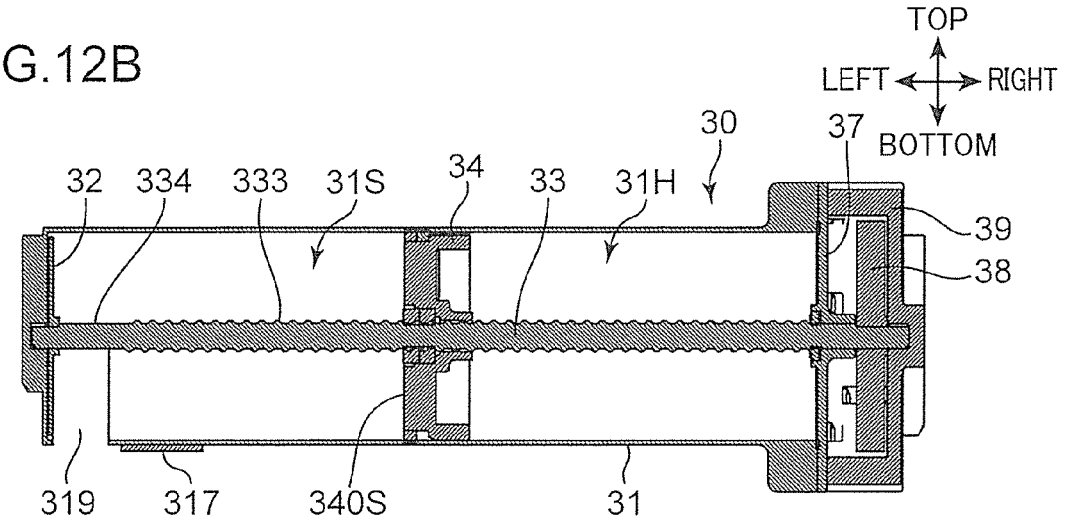
FIG. 12B is a sectional view illustrating a movement state of the movable wall in the developer container according to the first embodiment of the present invention.
Figure 12C:
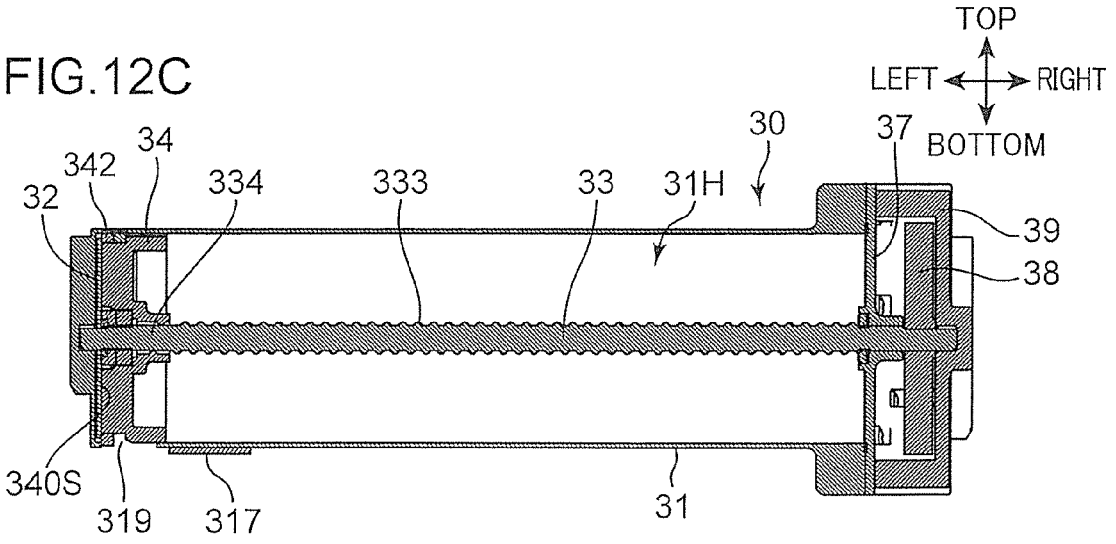
FIG. 12C is a sectional view illustrating a movement state of the movable wall in the developer container according to the first embodiment of the present invention.

FIGS. 12A, 12B, and 12C are sectional views each illustrating a movement state of the movable wall 34 in the toner container 30. FIG. 12A shows the movable wall 34 located at an initial position. FIG. 12B shows the movable wall 34 having moved from the initial position in the first direction. FIG. 12C shows the movable wall 34 located at a final position.

As shown in FIG. 12A, when the toner container 30 is newly mounted in the printer 100 by a user, the movable wall 34 lies at the initial position adjacent to the lid 37 and remote from the toner discharge port 319 at one end side of the internal space 31H in the first direction. Even if the storage space 31S is maximally filled with toner when the toner container 30 is manufactured, a slight space is left in the storage space 31S. This space is necessary to impart a predetermined fluidity to the toner contained in the storage space 31S before use of the toner container 30. However, in this case, because a boundary surface (top surface) of the toner contained in the storage space 31S is located under the top portion 312 with a specific gap therebetween, the toner sensor 31T can be seen to be difficult to detect the toner contained in the storage space 31S with high accuracy.

Accordingly, when the toner container 30 is newly mounted in the printer 100, the controller 50 (FIG. 8B) causes the motor M to drive the rotary gear 38 and the shaft 33 for rotation. This brings the male thread 333 into engagement with the female thread 340D to thereby impart a moving force to the movable wall 34 in the first direction toward the toner discharge port 319. When the movable wall 34 has moved slightly leftward from the initial position shown in FIG. 12A, the storage space 31S is filled up with toner. This allows the toner sensor 31T to detect the toner in the storage space 315. Upon receipt of the HIGH signal outputted from the toner sensor 31T, the controller 50 causes the movement of the movable wall 34 to stop.

In the present embodiment, the inner circumferential portion 31K of the container body 31 and the outer circumferential portion 34K (outer peripheral wall portion 341) of the movable wall 34 each have, in sectional view perpendicularly intersecting the first direction, a non-circular shape. This makes it possible to prevent the movable wall 34 from rotating with respect to the container body 31 even when the movable wall 34 receives a force for rotation around the shaft 33, owing to the engagement of the male thread 333 and the female thread 340D. Consequently, the movable wall 34 can be moved steadily in the first direction by a torque of the motor M. Further, the engagement of the male thread 333 and the female thread 340D allows the movable wall 34 to move steadily in the first direction with the outer circumferential portion 34K of the movable wall 34 being in close contact with the inner circumferential portion 31K of the container body 31 as described above.

As described above, the present embodiment employs the volume replenishment type toner supply method as shown in FIG. 5. Therefore, when the toner supply port 25 is sealed by the accumulation portion 29 (FIG. 5) existing in the developing device 20 from below, no replenishment toner falls from the toner container 30. On the other hand, when the toner of the accumulation portion 29 decreases as a result of supply of toner from the developing roller 21 of the developing device 20 to the photoconductive drum 121, toner flows into the developing device 20 through the toner supply port 25 from the toner discharge port 319. Consequently, toner that has existed under the toner sensor 31T disappears in the storage space 31S of the toner container 30, which causes the toner sensor 31T to output the LOW signal. Upon receipt of the signal, the controller 50 drives the motor M to move the movable wall 34 toward the toner discharge port 319 (FIG. 12B) until the toner sensor 31T outputs the HIGH signal. At this time, the stirring disc 32 disposed at the extreme end of the storage space 31S rotates with the shaft 33 to stir toner existing above the toner discharge port 319. This increases the fluidity of the toner, so that toner falls through the toner discharge port 319 constantly.

The movable wall 34 reaches the final position near the toner discharge port 319 as a result of progressive consumption of toner from the storage space 31S of the toner container 30, as shown in FIG. 12C. In this manner, the movable wall 34 gradually moves in the first direction to thereby convey toner in the storage space 31S to the toner discharge port 319 by pushing it. At this time, the storage space 31S gradually decreases as the movable wall 34 approaches the toner discharge port 319. Therefore, the space accommodating remaining toner gradually disappears in the toner container 30. Finally, at the final position shown in FIG. 12C, the movable wall 34 comes into contact with the stirring disc 32, so that the storage space 31S almost disappears. This makes it possible to reduce the amount of toner remaining in the storage space 31S of the container body 31 at the end of use of the toner container 30, as compared to the conventional toner container whose storage space volume does not change.

When the movable wall 34 reaches the final position facing the toner discharge port 319, the discharge port sealing part 341B (FIG. 10B) of the movable wall 34 covers the toner discharge port 319 from the inside of the container body 31 (FIG. 12C). In other words, the movable wall 34 has a shutter function of covering the toner discharge port 319 when the toner in the container body 31 runs out. This makes it possible to, even when the toner container 30 is dismounted from the printer 100 with the shutter 317 left open, prevent a small amount of toner remaining in the gap between the stirring disc 32 and the movable wall 34 from leaking or scattering out of the toner discharge port 319. In particular, in the present embodiment, the inner wall seal 342 being in close contact with the inner circumferential portion 31K of the container body 31 lies at the downstream end of the movable wall 34 in the moving direction during the movement of the movable wall 34. Consequently, the discharge port sealing part 341B covering the toner discharge port 319 is hardly adhered with toner, the discharge port sealing part 341B lying at the upstream side of the inner wall seal 342 in the moving direction of the movable wall 34. In addition, the width of the outer peripheral wall portion 341 is set to be longer than the width of the toner discharge port 319 in the first direction, so that the discharge port sealing part 341B has a size sufficient to cover the toner discharge port 319. Therefore, it is possible to reliably cover the toner discharge port 319 by the discharge port sealing part 341B.

Further, when the movable wall 34 seals the toner discharge port 319 at the final position as described above, a user can recognize that the toner has run out by seeing the sealing state. When the amount of toner remaining in the toner container 30 decreases, it is difficult to tell the amount of remaining toner by the weight of the toner container 30. On the other hand, in the case where the shutter 317 is slid as described above, a user can reliably recognize, by seeing that the toner discharge port 319 is sealed by the movable wall 34, that the toner in the toner container 30 has run out. Consequently, the user can be prompted to replace the toner container 30.

Further, the above-described function of the movable wall 34 of sealing the toner discharge port 319 can be utilized also in the case where a toner container 30 that has been partially used is dismounted from the printer 100 for some reason and stored with other empty toner containers 30. Specifically, a user is only required to choose a toner container 30 in which the toner discharge port 319 is not sealed by the movable wall 34, from among the plurality of stored toner containers 30.

In addition, in the case where the volume replenishment type toner supply method is employed as described above, when the toner in the toner container 30 runs out, no replenishment toner presses the accumulation portion 29, so that no pressing force is exerted to the developing device 20 from the toner container 30. In this case, there is a possibility that a part of the toner in the developing device 20 flows back toward the toner discharge port 319 through the toner supply port 25 because of various conditions in the developing device 20. However, in the present embodiment, the movable wall 34 seals the toner discharge port 319. This can prevent the toner from flowing back into the container body 31 from the developing device 20 (supply receiver).

In addition, in the present embodiment, the toner supply openings 340B for filling toner into the storage space S are formed in the movable wall 34 when the toner container 30 is manufactured, as described above. Therefore, there is no need to form a filling port in the container body 31 in addition to the toner discharge port 319. Therefore, the container body 31 can be formed in a simple shape. There may be provided toner containers 30 filled with different amounts of toner by varying the initial position of the movable wall 34 in the first direction. It is possible to change the volume of the storage space 31S by changing the initial position of the movable wall 34 at the time of filling toner. Also in this case, the toner supply openings 340B are formed in the movable wall 34 of each of the toner containers 31 and, therefore, it is not necessary to form a filling port in the container body 31 of each of the toner containers 30 at different positions from one another according to the amount of toner to be filled. This allows use of the container bodies 31 of the same type. Further, even in the case where toner containers 30 are filled with different amounts of toner, the initial position of the movable wall 34 of each of the toner containers 30 may be commonly set at a position shown in FIG. 12A. In this case, when a toner container 30 is mounted in the printer 100, a driving time for allowing the motor M to run is adjusted according to the output signal of the toner sensor 31T as an initial setting. Consequently, the storage space 31S is filled up with toner.

Further, the toner container 30 includes a backward movement preventing mechanism 55 (FIG. 11). The backward movement preventing mechanism 55 prevents the movable wall 34 having reached the toner discharge port 319 from moving back toward the initial position. In the present embodiment, the movable wall stopper portion 334 of the shaft 33 functions as the backward movement preventing mechanism 55 as shown in FIGS. 11 and 12A. The movable wall stopper portion 334 is defined by a specific part of the shaft 33, the specific part not bearing the male thread 333 and facing the toner discharge port 319, as described above. Therefore, the female thread 340D (FIG. 10B) of the movable wall 34 disengages from the male thread 333 and comes to lie in front of the movable wall stopper portion 334, immediately before the movable wall 34 reaches the final position shown in FIG. 12C. Thus, once the movable wall 34 reaches the final position shown in FIG. 12C, the female thread 340D is prevented from engaging with the male thread 333 again. Consequently, the movable wall 34 will never move back toward the lid 37 even if the rotary gear 38 is rotated accidentally inversely. Therefore, as described above, it is possible to reliably locate the movable wall 34 at the final position when the toner container 30 is empty of the toner. This can prevent leakage or scattering of toner out of the toner discharge port 319. Further, even in the case where a used toner container 30 is stored in a vertical position such that the first direction agrees with a vertical direction, the movable wall 34 is prevented from moving back toward the lid 37 by its own weight.

Further, at the final position shown in FIG. 12C, the inner wall seal 342 of the movable wall 34 resiliently radially biases the inner circumferential portion 31K of the toner container 30 from the inside. This allows the movable wall 34 to be stably locked at the final position and thereby further prevented from moving backward.

Figure 13B:
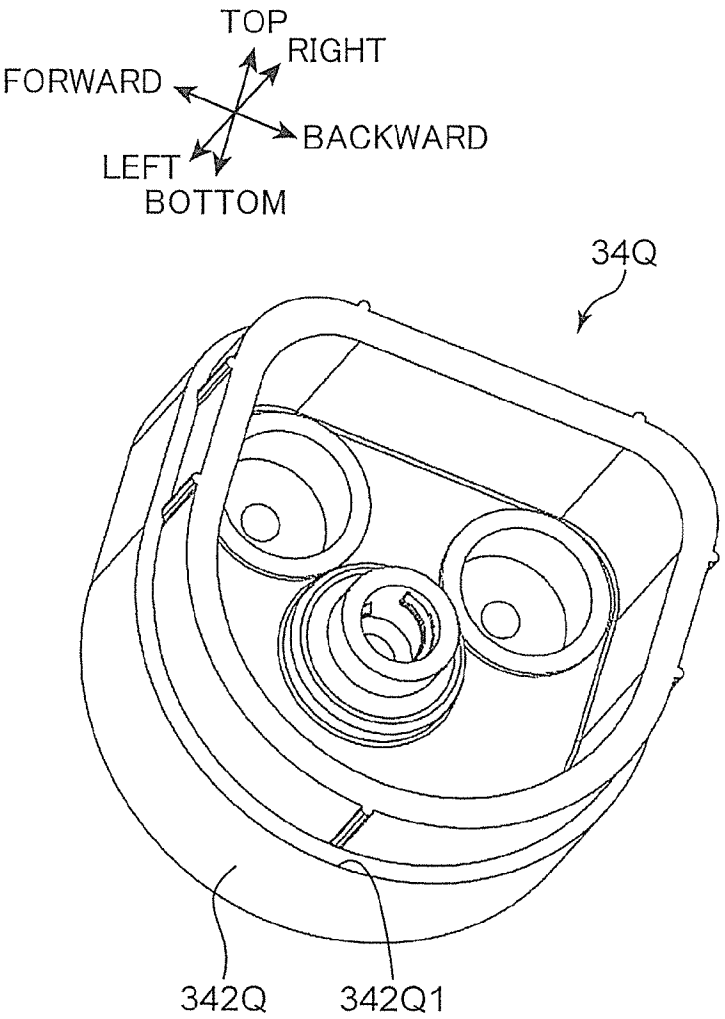
FIG. 13B is a perspective view of the movable wall of the developer container according to the second embodiment of the present invention.
Figure 13A:
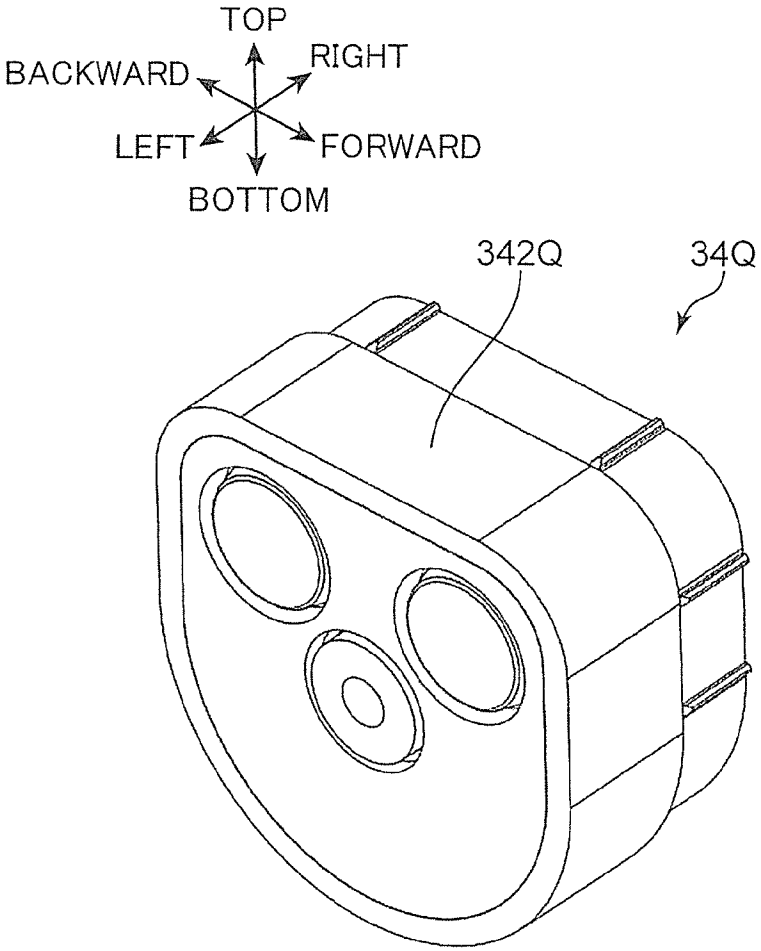
FIG. 13A is a perspective view of a movable wall of a developer container according to a second embodiment of the present invention.
Figure 14:
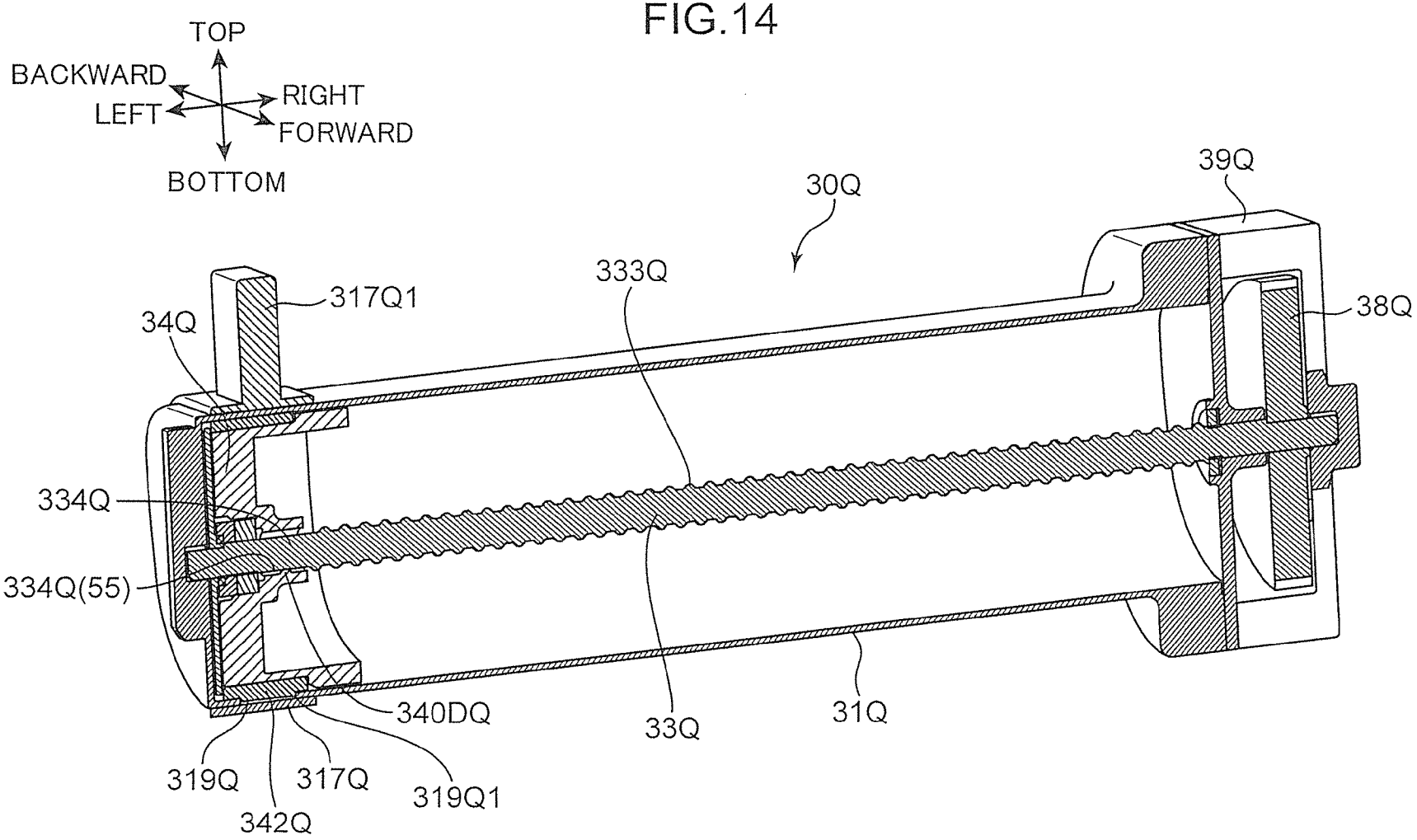
FIG. 14 is a sectional perspective view of the developer container according to the second embodiment of the present invention.

Now, a toner container 30Q according to a second embodiment of the present invention will be described with reference to FIGS. 13A, 13B and 14. FIGS. 13A and 13B are perspective views of a movable wall 34Q of the toner container 30Q. FIG. 14 is a sectional perspective view of the toner container 30Q with a shutter 317Q closed. In these drawings, elements that have functions identical to those of the corresponding elements of the toner container 30 in the first embodiment are denoted by the same reference numerals as in the first embodiment, with "Q" added at the end. The second embodiment differs from the toner container 30 of the first embodiment in the structures of the shutter 317Q and the movable wall 34Q. Accordingly, description will be made mainly regarding the difference, and repeated description of other common features will be omitted.

The toner container 30Q includes a container body 31Q, the shutter 317Q, and the movable wall 34Q. With reference to FIG. 14, the shutter 317Q is in the form of a cylinder and fitted on the outer surface of the container body 31Q. The shutter 317Q functions to close and open a toner discharge port 319Q) of the container body 31Q. The shutter 317Q includes a shutter holder 317Q1. The shutter holder 317Q1 projects upward from the shutter 317Q. The shutter holder 317Q1 is held by a user after the toner container 30Q is mounted in the container storage 109 (FIG. 2) of the printer 100. The user slides the shutter holder 317Q1 in a left-right direction to thereby move the shutter 317Q to a position at which the toner discharge port 319Q is covered by the bottom end of the shutter 317Q or to a position at which the toner discharge port 319Q is open.

With reference to FIGS. 13A and 13B, the movable wall 34Q has substantially the same structure and shape as those of the movable wall 34 of the first embodiment. However, as shown in FIG. 13A, an inner wall seal 342Q of the movable wall 34Q is formed to be wide in the left-right direction (first direction). The lateral width of the inner wall seal 342Q is set to be longer than the lateral opening width of the toner discharge port 319Q shown in FIG. 14.

Also in the second embodiment, when the movable wall 34Q reaches a final position, the inner wall seal 342Q covers the entirety of the toner discharge port 319Q from the inside of the container body 31Q, as shown in FIG. 14. Therefore, it is possible to reliably seal the toner discharge port 319Q by the movable wall 34Q. Further, the inner wall seal 342Q is made of a resilient material such as urethane. Therefore, the inner wall seal 342Q is partially released from a resiliently compressed state at the toner discharge port 319Q. Consequently, a part of the surface of the inner wall seal 342Q protrudes out of the toner discharge port 319Q radially outward of a shaft 33Q. This allows a part of the inner wall seal 342Q to be closely adhered to the peripheral edge of the toner discharge port 319Q and thereby improve its ability of sealing the toner discharge port 319Q.

Further, also in the second embodiment, the movable wall 34Q is prevented from moving back from the final position toward an initial position, owing to a movable wall stopper portion 334Q defined by a specific part of the shaft 33, the specific part not bearing a male thread 333Q and facing the toner discharge port 319Q. At this time, the protruding surface portion of the inner wall seal 342Q is caught on an opening end 319Q1 (FIG. 14) of the toner discharge port 319. Therefore, the movable wall 34Q is further prevented from moving back toward the initial position. In other embodiments, the inner wall seal 342Q may have such a shape as to allow a seal end 342Q1 (FIG. 13B) of the inner wall seal 342Q to be located at the left side (i.e. the downstream side in the moving direction of the movable wall 34Q) of the opening end 319Q1 when the movable wall 34Q is at the final position shown in FIG. 14. In this case, the seal end 342Q1 slightly protruding out of the toner discharge port 319 is likely to be easily caught on the opening end 319Q1, which will further prevent the movable wall 34Q from moving back toward the initial position.

When the shutter 317Q is slid by a user after the movable wall 34Q reaches the final position shown in FIG. 14, the toner discharge port 31Q is doubly sealed by the movable wall 34Q and the shutter 317Q. In particular, in the second embodiment, the toner discharge port 319Q is sealed from the inside and the outside of the container body 31Q. This makes it possible to stably prevent the vicinity of the container body 31Q from getting stained with toner.

Figure 15:
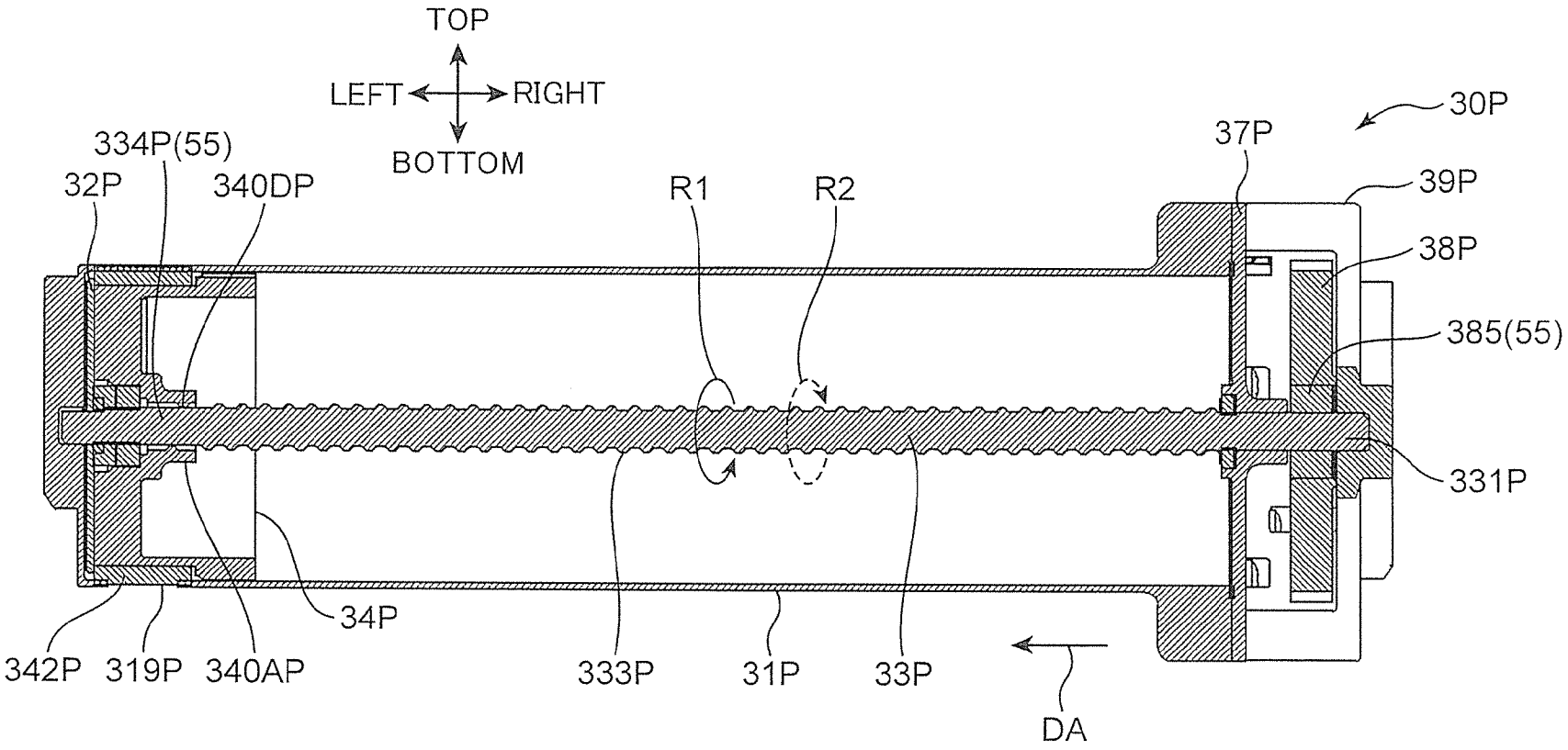
FIG. 15 is a sectional view of a developer container according to a third embodiment of the present invention.

Now, a toner container 30P according to a third embodiment of the present invention will be described with reference to FIG. 15. FIG. 15 is a sectional view illustrating a state that a movable wall 34P of the toner container 30P is at a final position. In FIG. 15, elements that have functions identical to those of the corresponding elements of the toner container 30 in the first embodiment are denoted by the same reference numerals as in the first embodiment, with "P" added at the end. The third embodiment differs from the toner containers 30 and 30Q of the first and the second embodiments in the aspect of including a one-way clutch 385. Accordingly, description will be made mainly regarding the difference, and repeated description of other common features will be omitted.

In the third embodiment, the one-way clutch 385, in addition to a movable wall stopper portion 334P disposed at a leading end of a shaft 33P, functions as the backward movement preventing mechanism 55. The one-way clutch 385 is secured to an inner circumferential portion of a rotary gear 38P and fitted on an outer circumferential portion of a first shaft end portion 331P.

While the rotary gear 38P coaxially connected to the shaft 33P is rotated in a first rotational direction (in the direction of an arrow R1 shown in FIG. 15) by the motor M (FIG. 8B), a male thread 333P of the shaft 33P rotates. This allows a bearing 340AP having a female thread 340DP to move integrally with the movable wall 34P in a first direction (in the direction of an arrow DA shown in FIG. 15). At this time, the one-way clutch 385 connecting the shaft 33P and the rotary gear 38P transmits a torque of the first rotational direction transmitted from the motor M to the rotary gear 38 to the first shaft end portion 331P.

After the movable wall 34P reaches a toner discharge port 319P, the toner container 30P is dismounted from the printer 100 by a user. At this time, even if the user accidentally touches the rotary gear 38P and rotates the rotary gear 38P in a second rotational direction (in the direction of an arrow R2 shown in FIG. 15) opposite to the first rotational direction, the shaft 33P is prevented from rotating in the second rotational direction, owing to the one-way clutch 385. Therefore, the movable wall 34P is prevented from moving back toward an initial position closer to a lid 37P. Consequently, it is possible to prevent scattering of toner out of the toner discharge port 319P. Further, in the third embodiment, the movable wall 34P is prevented from moving back toward the initial position also during the movement in the first direction. This prevents accidental expansion of the storage space in a container body 31P.

Figure 16:
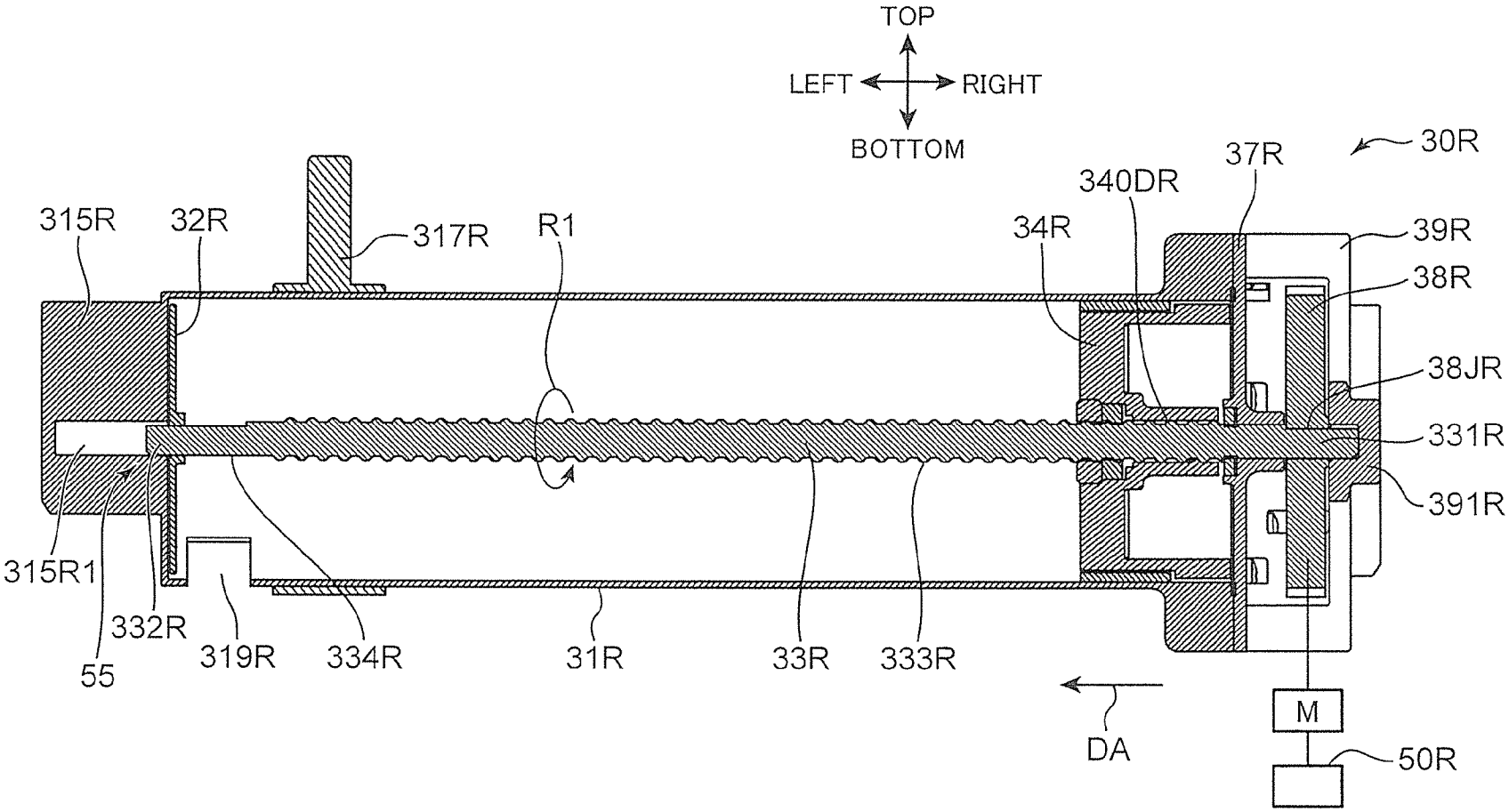
FIG. 16 is a sectional view of a developer container according to a fourth embodiment of the present invention.
Figure 17:
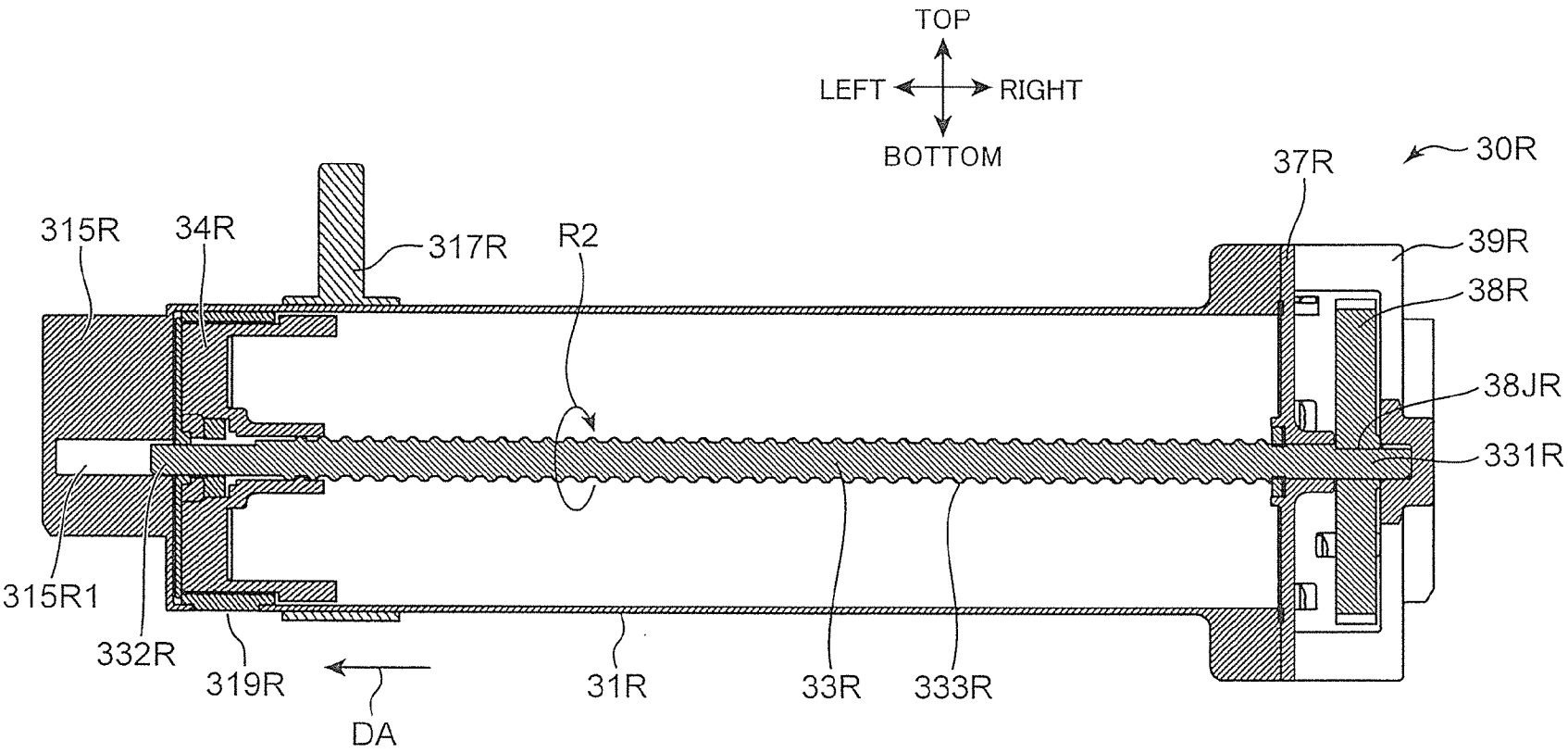
FIG. 17 is a sectional view of the developer container according to the fourth embodiment of the present invention.
Figure 18:
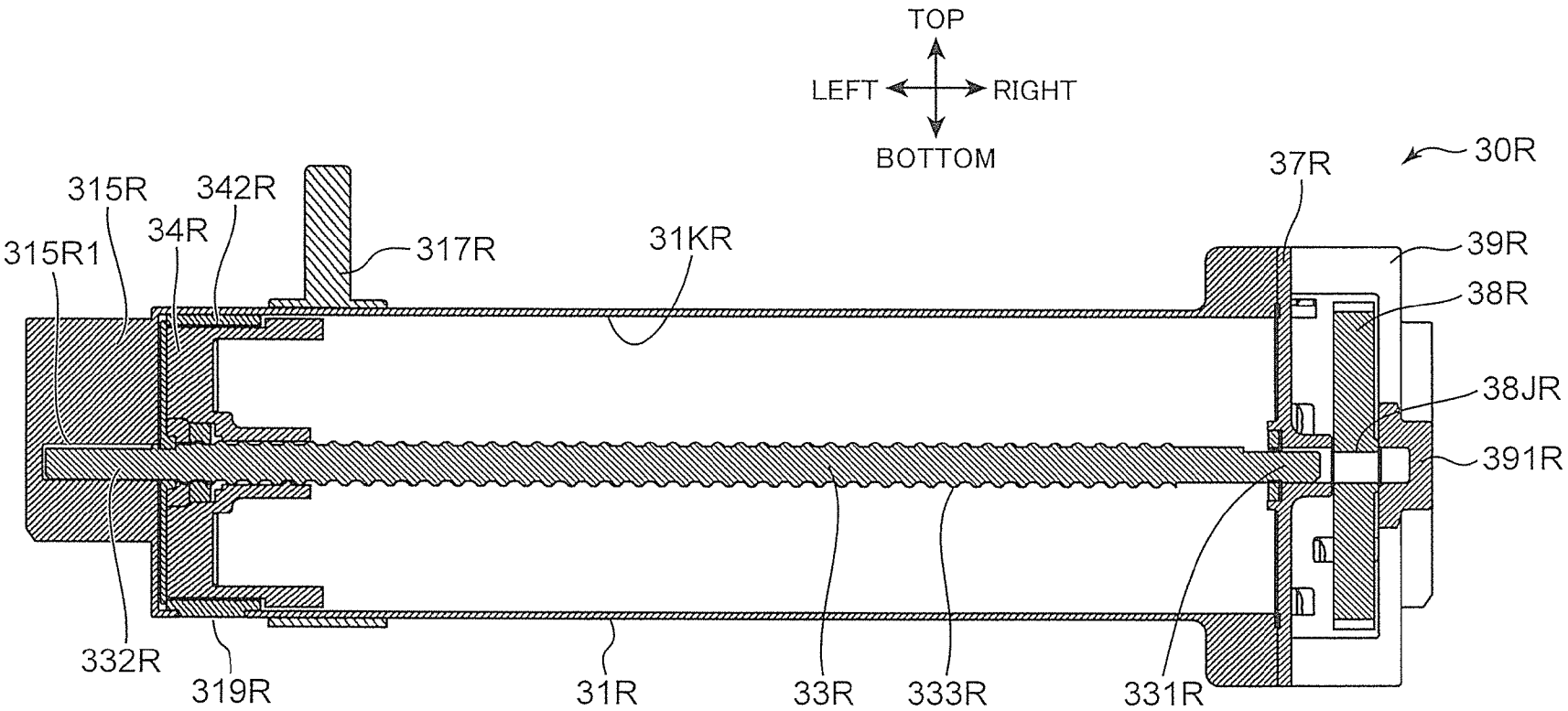
FIG. 18 is a sectional view of the developer container according to the fourth embodiment of the present invention.

Now, a toner container 30R according to a fourth embodiment of the present invention will be described with reference to FIGS. 16 to 18. FIG. 16 is a sectional view illustrating a state that a movable wall 34R of the toner container 30R is at an initial position. FIGS. 17 and 18 are sectional views illustrating a state that the movable wall 34R of the toner container 30R is at a final position. In FIGS. 16 to 18, elements that have functions identical to those of the corresponding elements of the toner container 30 in the first embodiment are denoted by the same reference numerals as in the first embodiment, with "R" added at the end. The fourth embodiment differs from the toner containers 30 and 30Q of the first and the second embodiments in that a shaft 33R slides. Accordingly, description will be made mainly regarding the difference, and repeated description of other common features will be omitted. In the fourth embodiment, a motor M (FIG. 16) disposed in the printer 100 is rotatable in forward and backward directions Similarly to the above-described embodiments, the toner container 30R includes a container body 31R, a stirring disc 32R, the shaft 33R (shaft), the movable wall 34R, a lid 37R, a rotary gear 38R (drive transmitter), and a cover 39R. The rotary gear 38R includes a gear shaft hole 38JR (shaft hole) and is coaxially disposed with respect to the shaft 33R.

A first shaft end portion 331R of the shaft 33 has a D-shape in sectional view. On the other hand, the gear shaft hole 38JR of the rotary gear 38R is in the shape of D. The first shaft end portion 331R passes through the gear shaft hole 38JR. The shaft 33R is integrally rotatable with the rotary gear 38R when the rotary gear 38R is rotated in a first rotational direction (in the direction of an arrow R1 shown in FIG. 16) by a controller 50R. In the fourth embodiment, the first shaft end portion 331R is slidable in a first direction with respect to the gear shaft hole 38JR.

Further, as shown in FIG. 16, a left wall 315R of the container body 31R includes a cavity 315R1. The cavity 315R1 is formed in the left wall 315R and axially faces a second shaft end portion 332R of the shaft 33R when the movable wall 34R is at the initial position. Similarly to the first shaft end portion 331R, the second shaft end portion 332R also has a D-shape in sectional view. The second shaft end portion 332R passes through a D hole formed in the stirring disc 32R to allow the stirring disc 32R to integrally rotate with the second shaft end portion 332R.

During the movement of the movable wall 34R to a toner discharge port 319R from the initial position shown in FIG. 16, the shaft 33R is imparted with a moving force in the right direction, owing to engagement of a male thread 333R with a female thread 340DR. However, because a distal end of the first shaft end portion 331R is in contact with a shaft cover portion 391R of the cover 39R, the shaft 33R is prevented from sliding rightward.

Upon arrival of the movable wall 34R at the toner discharge port 319R (FIG. 17), the controller 5OR controls the motor M to cause the rotary gear 38R to rotate in a second rotational direction (in the direction of an arrow R2 shown in FIG. 17) opposite to the first rotational direction. At this time, the shaft 33R is imparted with a moving force in the left direction (in the first direction or the direction of an arrow DA shown in FIG. 17), owing to the engagement of the male thread 333R with the female thread 340DR. Consequently, the shaft 33R slides leftward and the first shaft end portion 331R disengages from the gear shaft hole 38JR of the rotary gear 38R (FIG. 18). At the same time, the second shaft end portion 332R of the shaft 33R enters the cavity 315R1. Thus, the shaft 33R is prevented from receiving a torque from the rotary gear 38R. Therefore, the movable wall 34R having reached the final position is reliably prevented from moving back. In addition, also in the fourth embodiment, an inner wall seal 342R of the movable wall 34R pushes an inner circumferential portion 31KR of the container body 31R from the inside when the movable wall 34R is at the final position. Therefore, the movable wall 34R is prevented from moving back toward the initial position during the rotation of the rotary gear 38R in the second rotational direction. As described above, in the fourth embodiment, the shaft 33R and the cavity 315R1 function as the backward movement preventing mechanism 55.

The toner container 30 (30P, 30Q, 30R) and the printer 100 including the same according to the embodiments of the present invention have been described. According to the above-described configurations, it is possible to form an image on a sheet while efficiently using the toner in the toner container. Further, it is possible to reliably maintain the covered state of the toner discharge port after the end of use of the toner container. The present invention is not limited to the above-described embodiments and, for example, the following modified embodiments may be adopted.

(1) In the above-described embodiment, the printer 100 is illustrated as a monochrome printer. However, the present invention is not limited to this configuration. In particular, in the case where the printer 100 is provided as a tandem color printer, after the opening/closing cover 100C (FIG. 2) of the printer 100 is opened, toner containers 30 respectively corresponding to a plurality of colors may be mounted in the housing 101 from above so as to be adjacent to one another.

(2) In the first embodiment, the toner container 30 is mounted in the printer 100 in the longitudinal direction of the developing device 20. However, the present invention is not limited to this configuration. It may be configured such that the toner container 30 is mounted in a direction intersecting the longitudinal direction of the developing device 20.

(3) In the second embodiment, the toner container 30Q includes the shutter 317Q. However, the present invention is not limited to this configuration. As described above, the movable wall 34Q seals the toner discharge port 319Q when it reaches the final position. Accordingly, a film seal may be disposed at the toner discharge port 319Q, the film seal for sealing the toner discharge port 319Q until the toner container 30Q begins to be used. When the toner container 30Q is newly mounted in the printer 100, the film seal is peeled off by a user. Consequently, the toner discharge port 319Q is opened to communicate with an unillustrated developing device. Eventually, when toner in the toner container 30Q runs out, the inner wall seal 342Q of the movable wall 34Q covers the toner discharge port 319Q, as described above.

(4) The first embodiment employs the volume replenishment type toner supply method. However, the present invention is not limited to this method. An unillustrated toner sensor may be disposed at the developing device 20 so that when the toner sensor detects a decrease of toner in the developing device 20, the controller 50 drives the motor M to move the movable wall 34 in the first direction. This allows toner to fall through the toner discharge port 319 to flow into the developing device 20.

(5) In the first embodiment, the bearing 340A is disposed in the central part of the movable wall 34. However, the present invention is not limited to this configuration. The bearing 340A may be disposed in another area of the movable wall 34. It may be configured such that the bearing 340A is disposed in an upper part of the movable wall 34, and the shaft 33 correspondingly extends in an upper part of the container body 31. In this case, pressure of toner that is exerted on the shaft seal 343 (FIG. 10A) will be low, so that the shaft seal 343 can maintain a higher level of sealing ability.

The invention claimed is:

1. A developer container comprising:

a container body having opposite first and second ends and including an inner surface defining a cylindrical internal space extending in a longitudinal direction, and a storage space provided in the internal space for containing developer, the container body includes a wall portion at the first end of the container body in the longitudinal direction and defining a first end surface of the internal space, a lid attached to the second end of the container body and closing the internal space, the container body being formed with a developer discharge port in a lower part of the inner surface in proximity to the first end surface of the internal space and communicating with the storage space for discharging developer therethrough;

a movable wall disposed in the internal space of the container body, and including an outer surface disposed slidably in close contact with the inner surface, and a conveying surface defining the storage space in cooperation with the inner surface of the container body, the movable wall being movable in the longitudinal direction from an initial position in proximity to the second end of the container body to the developer discharge port lying in proximity to the first end of the internal space to seal the developer discharge port by the outer surface, while conveying the developer in the storage space to the developer discharge port;

a shaft extending in the longitudinal direction in the internal space and rotatably supported on the wall portion and the lid, the shaft including a first engaging portion in the form of a helical ridge projecting from an outer surface thereof;

a drive transmitter configured to transmit a torque generated by a specific driving source to the shaft; and a bearing disposed in the movable wall, and including a second engaging portion projecting from an inner surface thereof and engageable with the first engaging portion, the bearing allowing the shaft to pass therethrough a backward movement preventing mechanism configured to prevent the movable wall at the developer discharge port from moving back toward the initial position, wherein the drive transmitter includes a rotary gear coaxially connected to the shaft, the rotary gear being rotatable in a first rotational direction to thereby allow the first engaging portion of the shaft to engage with the second engaging portion of the bearing to move the movable wall in the longitudinal direction, and the backward movement preventing mechanism includes a one-way clutch connecting the shaft and the rotary gear, and preventing the shaft from rotating in a second rotational direction opposite to the first rotational direction.

2. A developer container according to claim 1, wherein the backward movement preventing mechanism is defined by a specific part of the shaft that faces the developer discharge port and bears no first engaging portion.

3. A developer container according to claim 1, further comprising a sealing member defining the outer surface of the movable wall and resiliently compressed between the inner surface of the container body and the movable wall.

4. A developer container according to claim 1, wherein the inner surface of the container body and the outer surface of the movable wall each have, in a sectional view perpendicularly intersecting the longitudinal direction, a non-circular shape.

5. An image forming apparatus, comprising:

a developer container according to claim 1;

an image carrier having a surface for allowing an electrostatic latent image to be formed thereon and operable to carry a developed image;

a developing device configured to receive the developer supplied from the developer container and to supply the developer to the image carrier; and a transfer section configured to transfer the developed image from the image carrier onto a sheet.

* * * * *